United States Patent [19]

Mitarai

[11] Patent Number: 4,655,112

[45] Date of Patent: Apr. 7, 1987

[54] AUTOMATIC MUSIC PLAYING APPARATUS

[75] Inventor: Tsuyoshi Mitarai, Yokohama, Japan

[73] Assignee: Casio Computer Co., Ltd., Tokyo, Japan

[21] Appl. No.: 746,940

[22] Filed: Jun. 20, 1985

Related U.S. Application Data

[63] Continuation of Ser. No. 562,420, Dec. 16, 1983, abandoned.

[30] Foreign Application Priority Data

Dec. 30, 1982 [JP] Japan ..... 57-232842
Dec. 30, 1982 [JP] Japan ..... 57-232845

[51] Int. Cl.[4] ..... G10F 1/00
[52] U.S. Cl. ..... 84/1.03
[58] Field of Search ..... 84/1.01, 1.03, 1.24, 84/DIG. 12, 1.28

[56] References Cited

U.S. PATENT DOCUMENTS

| | | | |
|---|---|---|---|
| 4,012,979 | 3/1977 | Wemekamp | 84/1.01 |
| 4,257,304 | 3/1981 | Deutsch | 84/1.23 |
| 4,282,788 | 8/1981 | Yamaga et al. | 84/1.03 |
| 4,387,620 | 6/1983 | Okamoto et al. | 84/1.03 |
| 4,448,104 | 5/1984 | Hosaii | 84/1.03 |
| 4,453,440 | 6/1984 | Mitarai | 84/1.22 |
| 4,454,796 | 6/1984 | Inoue et al. | 84/1.03 |
| 4,491,049 | 1/1985 | Mizuta et al. | 84/1.01 |

FOREIGN PATENT DOCUMENTS

| | | |
|---|---|---|
| 0053892 | 6/1982 | European Pat. Off. . |
| 3141326 | 6/1982 | Fed. Rep. of Germany . |
| 3102643 | 8/1982 | Fed. Rep. of Germany . |
| 1566663 | 5/1980 | United Kingdom . |
| 2109978 | 6/1983 | United Kingdom . |
| 2118756 | 11/1983 | United Kingdom . |
| 2125602 | 3/1984 | United Kingdom . |

OTHER PUBLICATIONS

The Fairlight CMI, advertisement in Computer Music Journal, vol. 3, No. 4, Dec. 1979.

F. W. Isen, "An Electronic Music Synthesizer Controlled by Digital Logic", Jun. 1978 (University of Louisville).

*Primary Examiner*—Forester W. Isen

*Attorney, Agent, or Firm*—Frishauf, Holtz, Goodman & Woodward

[57] ABSTRACT

A plurality of pieces of tone information forming a chord to be simultaneously sounded are supplied from a keyboard switch unit to a CPU. The CPU supplies time data indicating that the tone generating timings of the plurality of tone information are simultaneous to the plurality of tone information, and stores as digital information the tone information in one of a number of memory areas of a RAM as designated by an address register unit.

22 Claims, 33 Drawing Figures

FIG. 12A-I
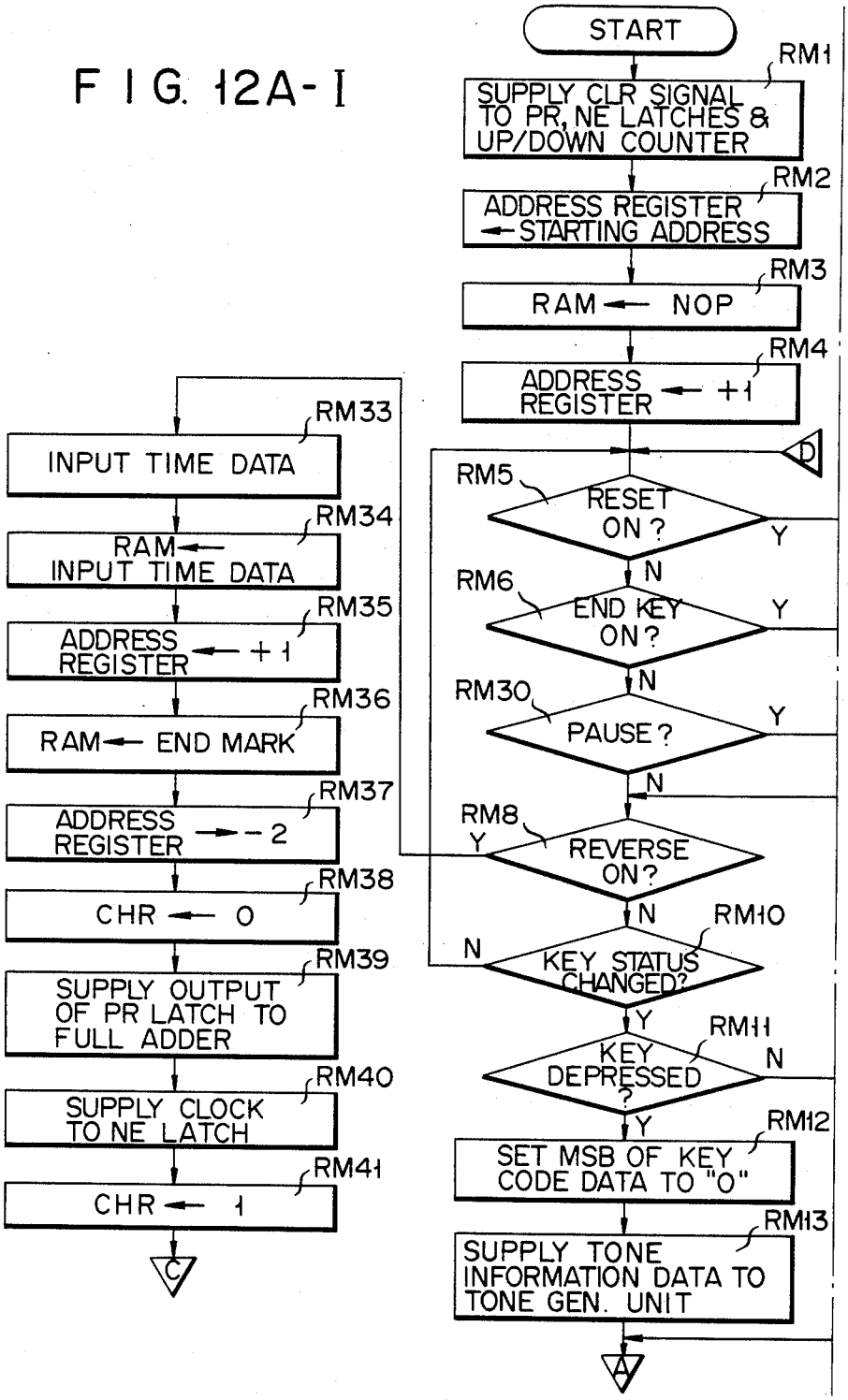

FIG. 12A-II
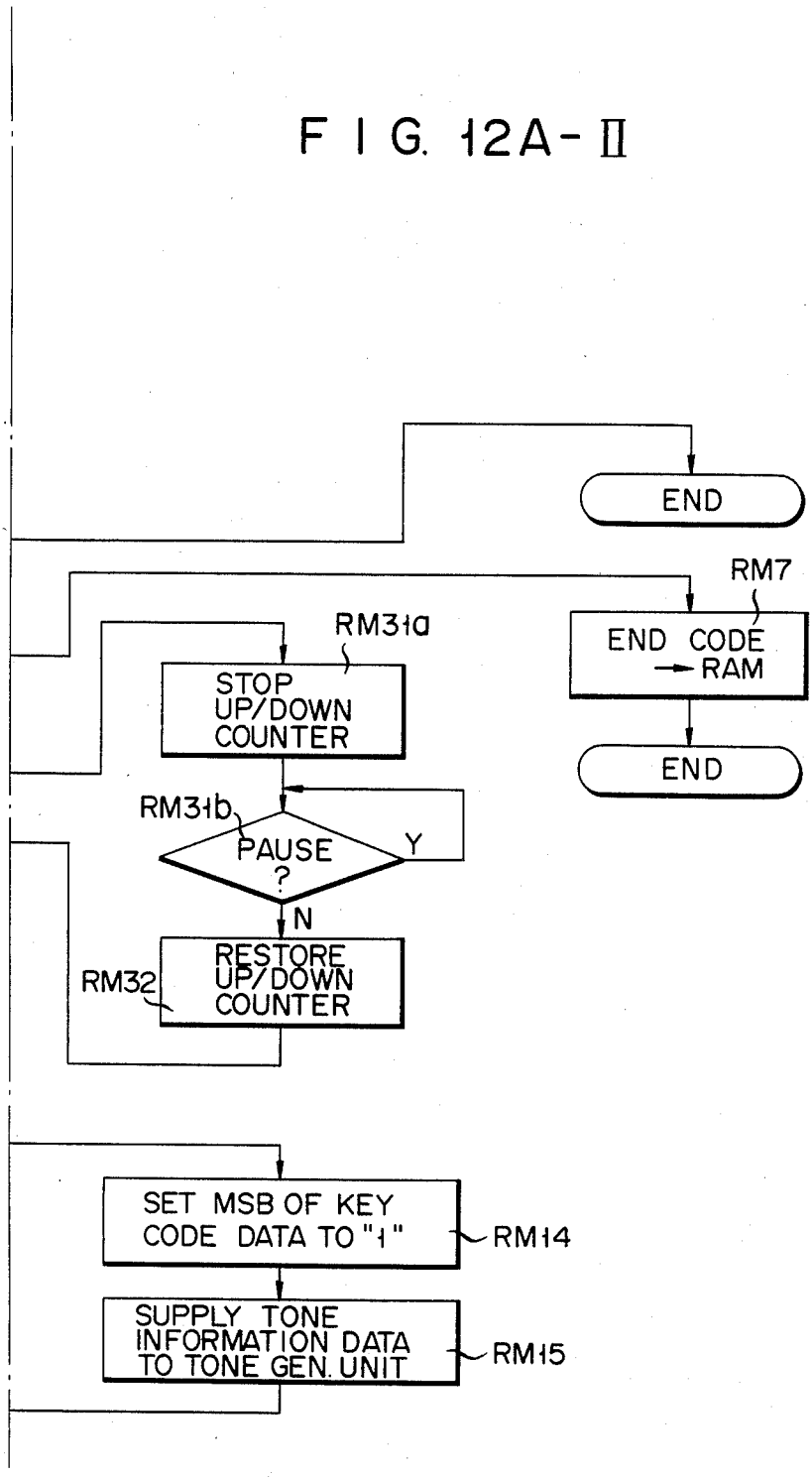

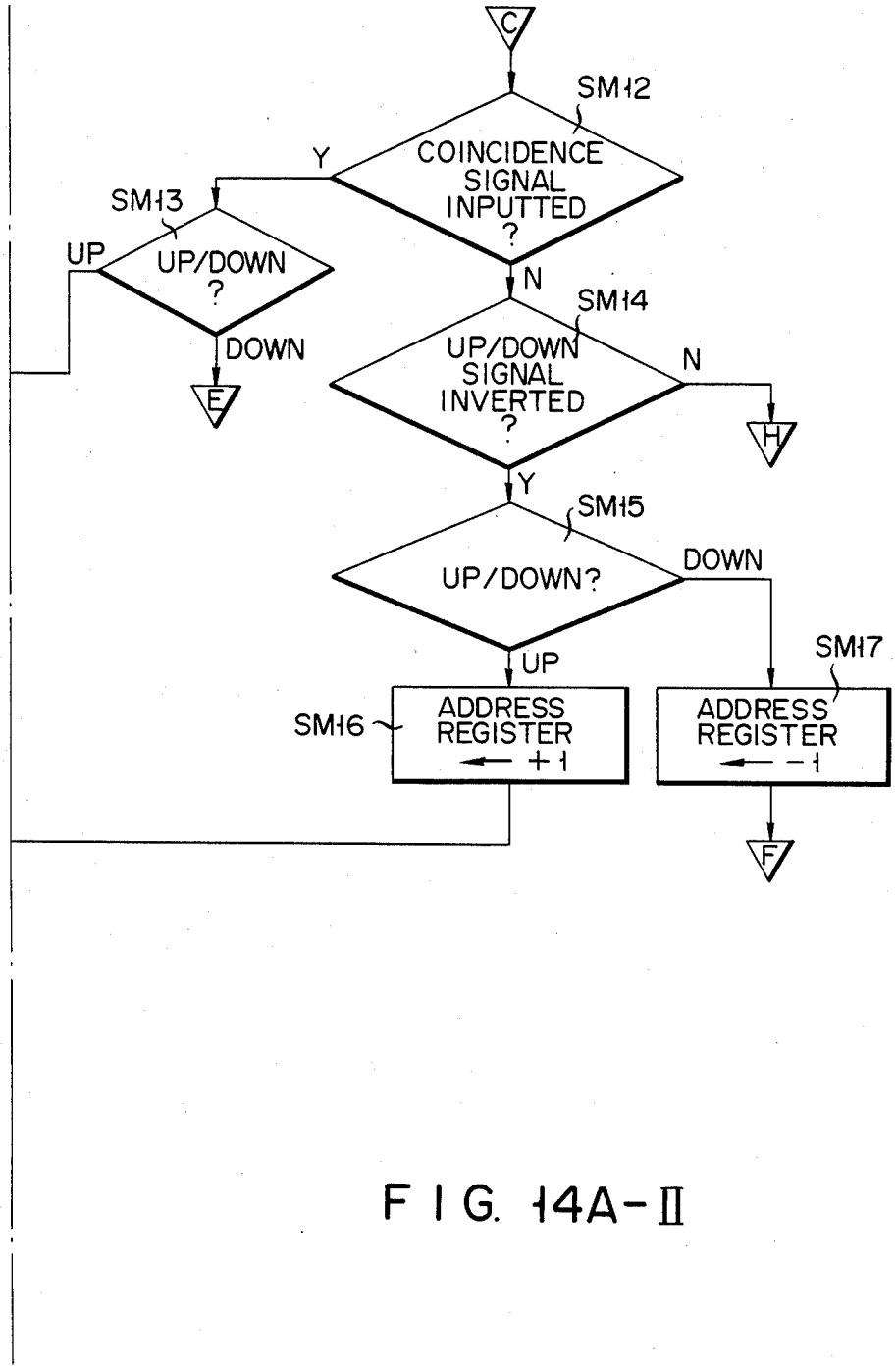
FIG. 14A-II

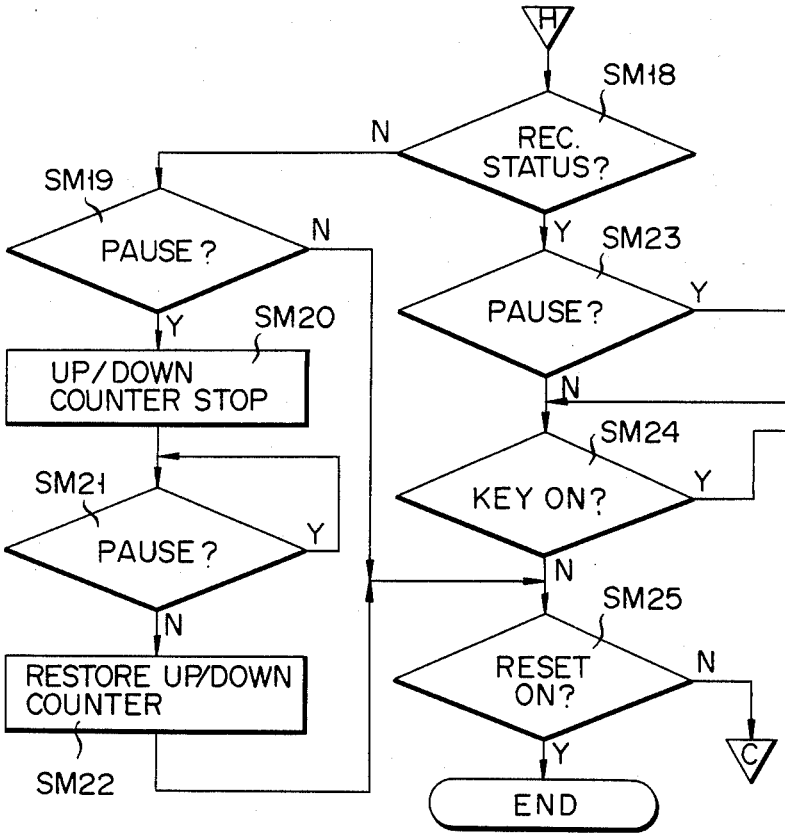
FIG. 14B-I

FIG. 14B-II
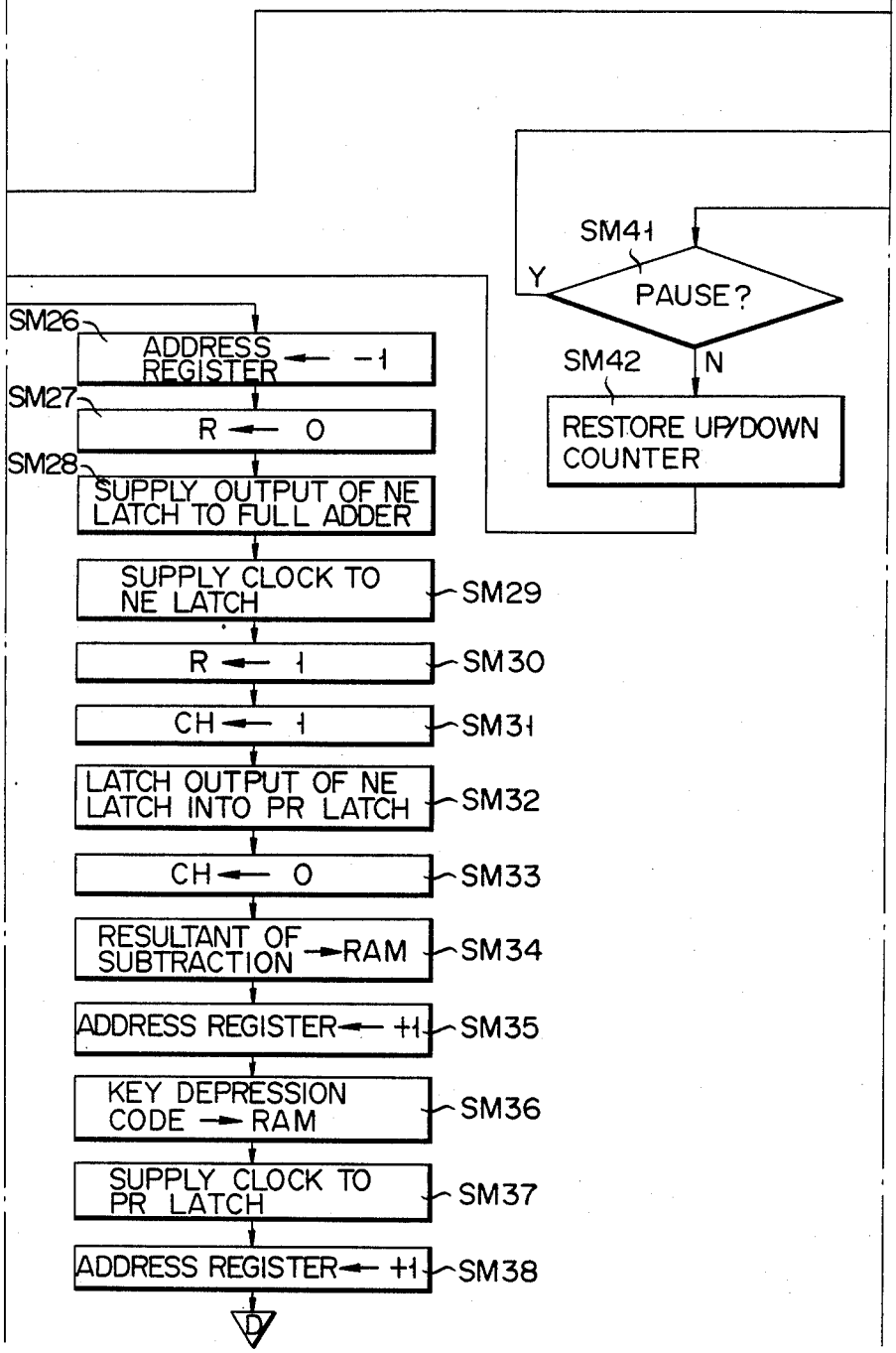

FIG. 14B-III
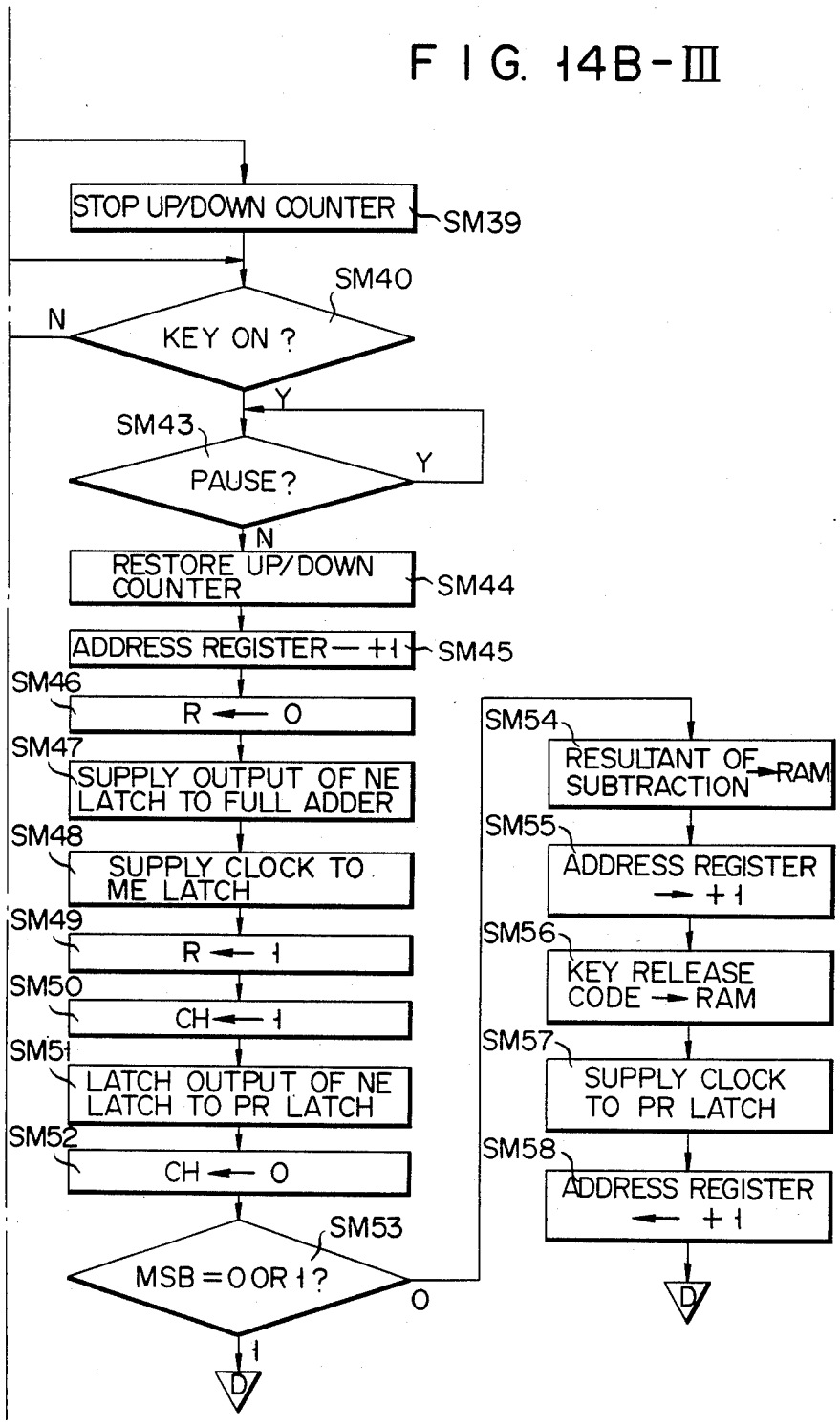

FIG. 16A

| |
|---|
| A3 OFF |
| T1 |
| G3 ON |
| T3 |
| G3 OFF |
| T1 |
| F3 ON |
| T3 |
| F3 OFF |
| T1 |
| E3 ON |
| T12 |
| E3 OFF |
| T4 |
| E3 ON |
| T3 |
| E3 OFF |
| T1 |
| G3 ON |
| T3 |
| END |

FIG. 16B

| |
|---|
| E3 ON |
| T12 |
| E3 OFF |
| T4 |
| G3 ON |
| T3 |
| G3 OFF |
| T1 |
| C2 ON |
| T3 |
| C2 OFF |
| T1 |
| E2 ON |
| T6 |
| E2 OF |
| T2 |

FIG. 18A

| |
|---|
| A3 OFF |
| T1 |
| G3 ON |
| T3 |
| G3 OFF |
| T1 |
| F3 ON |
| T3 |
| F3 OFF |
| T1 |
| E3 ON |
| T12 |
| E3 OFF |
| T4 |
| E3 ON |
| T3 |
| E3 OFF |
| T1 |
| G3 ON |
| T3 |
| END |

FIG. 18B

| |
|---|
| F3 OFF |
| T1 |
| E3 ON |
| T8 |
| E3 OFF |
| T8 |
| E3 ON |
| T3 |
| E3 OFF |
| T1 |
| G3 ON |
| T3 |
| G3 OFF |
| T1 |
| C2 ON |

AUTOMATIC MUSIC PLAYING APPARATUS

The application is a continuation, of application Ser. No. 562,420, filed 12/16/83, now abandoned.

BACKGROUND OF THE INVENTION

The present invention relates to an automatic music playing apparatus with memory devices for memorizing tone information which is read out therefrom, for carrying out an automatic music play.

An automatic music playing apparatus for automatically playing a melody and a rhythm has previously been employed in practical use. Some of the known automatic music playing apparatuses can store tone information such as melody in a memory device such as a RAM (random access memory) or a magnetic tape, by operating a keyboard by the player himself. The stored tone information can be read out for an automatic music play.

Since the conventional automatic music playing apparatus has, however, the function of sequentially reading out and generating a tone at one time, the apparatus cannot automatically perform, for example, a chord which simultaneously employs a plurality of tones and can thus automatically play music with a monotonous expression.

When part of tone information stored in a memory device is corrected, an automatic play or reproduction is carried out from the beginning of the music, and a correction is made by the keyboard in the performance from the position to be corrected when the tone to be corrected is reproduced. However, in case of music having a fast tempo, the timing of depressing a key for correcting the tone can hardly be accurately taken, and the play for correcting the tone must be repeatedly executed.

SUMMARY OF THE INVENTION

Accordingly, it is an object of the present invention to provide an automatic music playing apparatus capable of recording and reproducing a plurality of tones to be simultaneously produced such as a chord, with a simple structure.

According to the present invention, there is provided an automatic music playing apparatus which comprises tone information input means; memory means for digitally storing a plurality of tone information inputted from the tone information input means and to be simultaneously produced; and tone signal generation means for generating a tone signal based on a plurality of tone information read out from the memory means and to be simultaneously produced.

BRIEF DESCRIPTION OF THE DRAWINGS

FIGS. 12A-I, 12A-II and 12B are flow charts of a recording process of melody information containing a pause;

FIGS. 14A-I, 14A-II, 14B-I, 14B-II, 14B-III and 14C are respectively flow charts of a reproducing process of melody information;

FIGS. 16A and 16B are views showing the stored states of the RAM at the time of editing tone information of the music in FIG. 15;

FIGS. 18A and 18B are views showing the stored state of the RAM at the time of editing tone information of the music in FIG. 17.

DETAILED DESCRIPTION OF THE PREFERRED EMBODIMENTS

Figure 1:
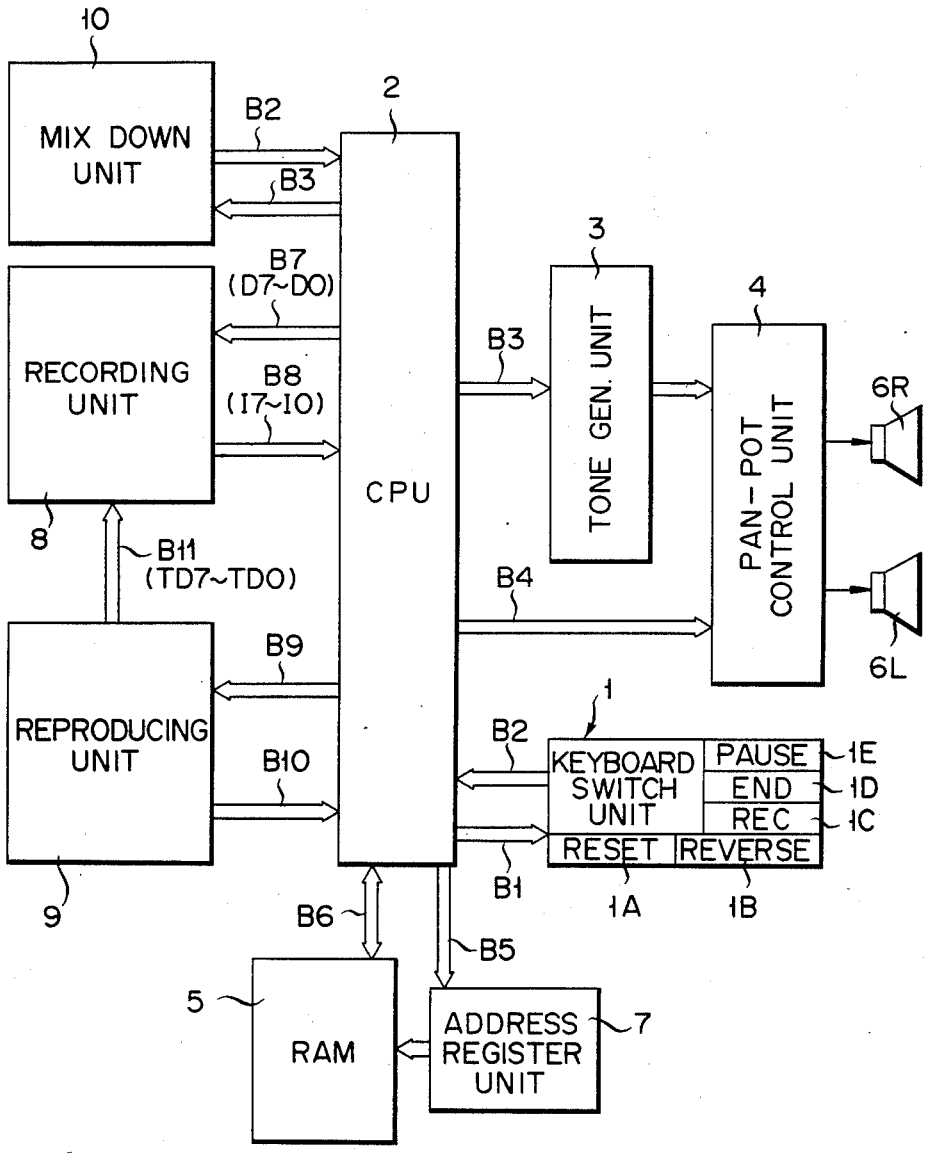
FIG. 1 is a block diagram showing an embodiment of an entire structure of an electronic musical instrument according to the present invention.

In FIG. 1, a keyboard switch unit 1 has a plurality of performance keys (not shown) for performing a melody, and further various switches for producing a variety of effects such as tone-colors, vibrato, sustain, stereophonic pan-potential, normal rhythm, fill-in rhythm, automatic accompaniment and the like. In addition, the switch unit 1 has switches for automatic playing, e.g., a reset switch 1A, a reverse switch 1B, a record switch 1C, an end key 1D and a pause key 1E. This pause key 1E is used to correct tone information temporarily stored in a memory, and is not indispensable as an element in the automatic music playing apparatus of the present invention, and will be described later. A CPU (central processing unit) 2 periodically outputs a key scan signal to the switch unit 1 through a bus line B1 to scan the switch unit 1. The switch unit 1 outputs output signals from the respective keys and switches to the CPU 2 in response to the scan signal through a bus line B2. The CPU 2 produces, for example, a tone generation instruction information to a tone generation unit 3 in response to the output from the switch unit 1, through a bus line B3, thereby allowing the tone generation unit 3 to generate a tone signal such as a melody or an automatic accompaniment and to supply the signal to a pan-pot control unit 4. Further, the CPU 2 outputs control information to the tone image pan-pot control unit 4 through a bus line B4 in accordance with tone image pan-potential information preset in a RAM (random access memory) 5 to be described later, thereby allowing the control unit 4 to set tone image pan-potential to the tone signal and to output right and left signals corresponding to right and left speakers 6R and 6L, thus causing the speakers 6R and 6L to generate tones. This pan-pot control unit 4 employs, for example, the pan-pot control unit disclosed in U.S. patent application Ser. No. 530,028 and other known pan-pot control units.

The RAM 5 is controlled in the reading and writing operations of data in accordance with address control information supplied to an address register unit 7 through a bus line B5 from the CPU 2. The data are communicated between the CPU 2 and the RAM 5 through a bus line B6. In this case, the RAM 5 stores tone information which represents the pitch, tone length and pause of music (hereinafter called "melody information"), and performance information for producing various effects such as ON and OFF of tone-colors, vibrato, sustain, tone image pan-potential, fill-in rhythm in respective areas. The address register unit 7 has independent address counters for the melody information and the performance information, respectively. Thus, the melody information and the performance information are respectively simultaneously read out in parallel at an automatic performance time as the melody progresses, thereby carrying out an automatic performance. In the particular embodiment, three areas for storing the melody information are provided.

A recording unit 8 generates time information (data I7 to I0) representing a tone length from time information (data D7 to D0) supplied from the CPU 2 through a bus line B7 and time information (data TD7 to TD0) supplied from a reproducing unit 9 through a bus line B11, supplies the time information (data I7 to I0) to the CPU 2 through a bus line B8, thereby allowing the CPU 2 to write the melody or performance information in the RAM 5.

The reproducing unit 9 receives information produced according to the melody and performance information read out from the RAM 5 at a reproducing time from the CPU 2 through a bus line B9, generates data for processing the reproduction of the information, and supplies the data to the CPU 2 through a bus line B10, and supplies the time information (TD7 to TD0) to the recording unit 8 at a recording time as described above. The CPU 2 is a processor for controlling all the operations of this electronic musical instrument, and has a structure known per se, and the detailed description will be omitted. The recording unit 8 and the reproducing unit 9 respectively have four equal circuits, which are operated independently from each other.

A mix down unit 10 is a circuit for synthesizing pieces of tone information written in the different areas (which are also called "different channels") in the RAM 5 to write the synthesized information in any channel. In this case, necessary data are communicated between the mix down unit 10 and the CPU 2, and the detail will be described later. An address register (which will be called "ADRM") for addressing the channel when the synthesized data produced by the mix down processing of the mix down unit 10 is inputted to any of the channels of the RAM 5, is provided in the address register unit 7.

Figure 2:
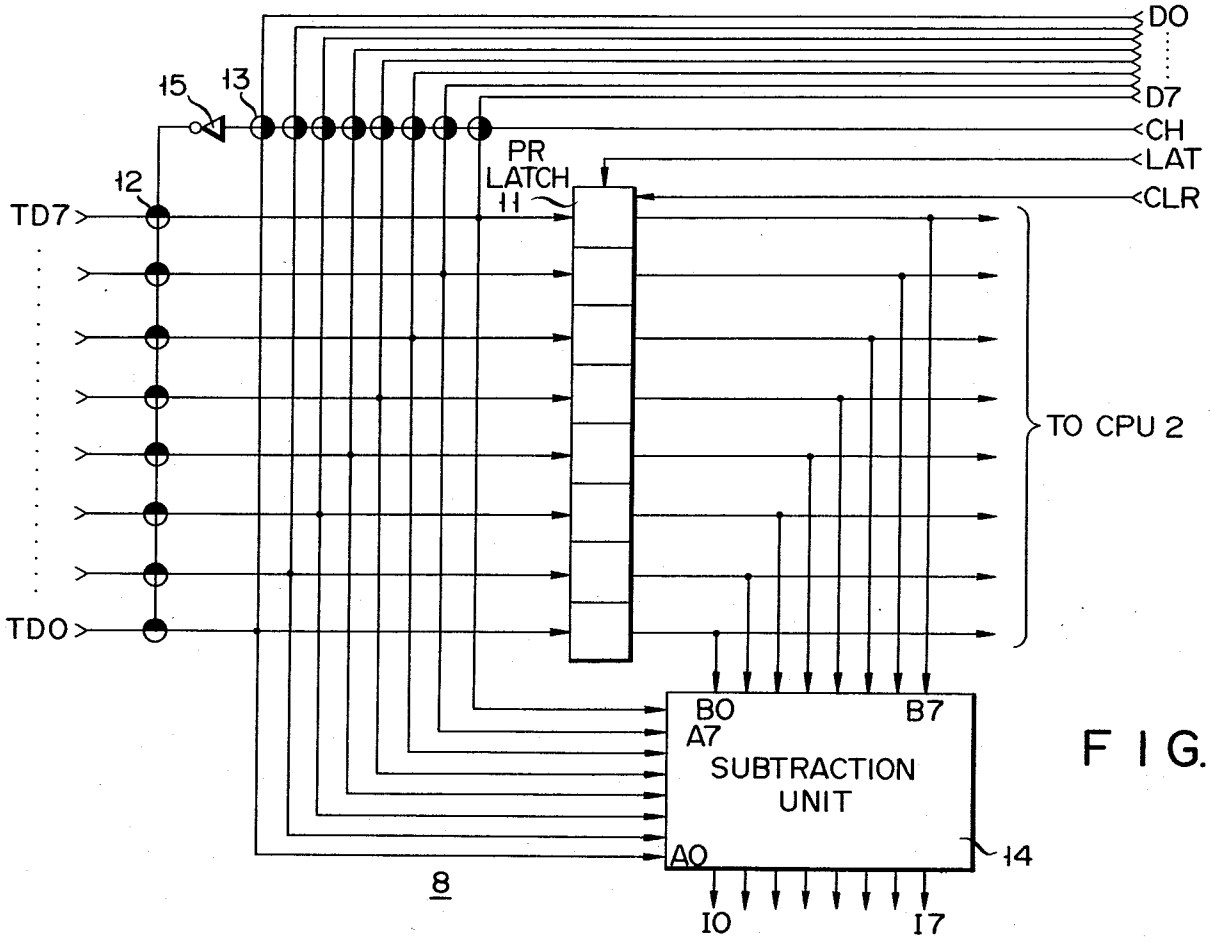
FIG. 2 is a block diagram showing an example of the circuit arrangement of a recording unit shown in FIG. 1.

The constitution of the recording unit 8 will be described with reference to FIG. 2. A PR latch 11 latches a signal LAT produced from the CPU 2 when the counted output data of an up/down counter in the reproducing unit 9 (to be described later) are inputted as TD7 to TD0 to the latch 11 through transfer gate group 12. When a reproducing operation is temporarily stopped at the reproducing time, a rewinding is carried out by the operation of the reverse switch 1B and a recording operation is then newly started, the latch data of the latch 11 is supplied through the CPU 2 to a full adder in the reproducing unit 9, and the output data of the full adder at that time is, on the contrary, supplied and latched as data D7 to D0 through the CPU 2 and further through transfer gate group 13 to the latch 11. The data latched to the latch 11 is applied to the B input terminals (B7 to B0) of a subtraction unit 14. The data TD7 to TD0 are inputted to the A input terminals (A7 to A0) of the subtraction unit 14. The subtraction unit 14 subtracts the input data of the A input terminals by the input data of the B input terminals, and supplies the resultant data I7 to I0 through the CPU 2 to the RAM 5, which thus stores the data I7 to I0, which indicate, in case of the melody information, time data for supplying a key-ON time and a key-OFF time and, in case of the performance information of the effects, represent time data indicating the effect generation period. The transfer gate group 12 are controlled in accordance with a signal CH outputted from the CPU 2 through an inverter 15 to the gates of the transfer gates 12, and the transfer gate group 13 are controlled in accordance with the signal CH applied directly to the gates of the transfer gates 13.

The reproducing unit 9 will be described with reference to FIGS. 5A and 5B. An up/down counter 17 is an 8-bit counter. The counter 17 is cleared by a clear signal CLR outputted when the CPU 2 starts recording or reproducing operation, and serves thereafter to count clocks based on signals outputted from a tempo oscillator 18.

The frequency of the oscillated output of the oscillator 18 is variable by a tempo variable resistor 19, and the output of the oscillator 18 is inputted to an AND gate 20. The output of a tempo stop switch ESW is inputted to the other terminal of the AND gate 20, thereby controlling the AND gate 20. The output of the AND gate 20 is inputted to a T flip-flop 21 and a transfer gate 23. The set output of the flip-flop 21 is inputted to a T flip-flop 22 and a transfer gate 24. Further, the set output of the flip-flop 22 is inputted to a transfer gate 25. The outputs of a tempo acceleration switch CSW, a normal switch FSW and a slow tempo switch DSW made of tempo control switches, only one of which becomes ON, are respectively applied to the gates of the transfer gates 23, 24 and 25, thereby controlling the transfer gates 23, 24 and 25. The outputs of the transfer gates 23, 24 and 25 are counted as the tempo clocks by the counter 17. The flip-flops 21 and 22 form a frequency divider in such a manner that the outputs of the flip-flops 21 and 22 become, in frequency, ½ and ¼ of the output of the oscillator 18.

The up and down counting operations of the counter 17 are respectively controlled by the set output signal $\overline{\text{UPDWN}}$ of a flip-flop 26. In other words, the outputs of a forward switch BSW and a reverse switch ASW (which is equivalent to the reverse switch 1B in FIG. 1) made of a double lock switch are respectively inputted to the set input terminal S and the reset input terminal R of the flip-flop 26. The bit outputs of the counter 17 are respectively inputted to one terminals of corresponding exclusive OR gates $27_7$ to $27_0$, and supplied as data TD7 to TD0 to the recording unit 8. The corresponding bit outputs of NE latches 28 of 8 bit capacity are respectively inputted to the other terminals of the gates $27_7$ to $27_0$. The outputs of the gates $27_7$ to $27_0$ are respectively inputted to a NOR gate 29, and the output of the gate 29 is, in turn, supplied as a coincidence signal to the CPU 2. In other words, the gates $27_7$ to $27_0$ and NOR gate 29 construct a coincidence circuit.

When the CPU 2 outputs a latch clock, the resultant data of addition or subtraction from the S output terminals S7 to S0 of a full adder 30 is latched to the NE latch 28. The latch 28 is cleared by a clear signal CLR outputted from the CPU 2 when the CPU 2 starts recording or reproducing operation. The latch data of the latch 28 is fed back and inputted through transfer gate group 31 to the A input terminals A7 to A0 of the full adder 30. The outputs of exclusive OR gates $32_7$ to $32_0$ are respectively inputted to the B input terminals B7 to B0 of the full adder 30, and further the output of the AND gate 33 is inputted to the carry input terminal CIN through an inverter 34 and a transfer gate 35. The time data from the PR latch 11 in the recording unit 8 is inputted to the one terminals of the gates $32_7$ to $32_0$ in response to the key operation when a new recording operation for correction is carried out after rewinding at the reproducing time. The output of the gate 33 is applied to the terminals of the gates $32_7$ to $32_0$ through the inverter 34 and the gate 35.

The set output of the flip-flop 26 and the signal R outputted from the CPU 2 are inputted to the AND gate 33. This signal R is outputted normally as "1", and temporarily outputted as "0" at the time of correcting the recording operation. The output of the gate 33 is supplied to the CPU 2. A signal CHR outputted from the CPU 2 is applied to the gates of the gate group 31 and the gate 35, thereby controlling the gate group 31 and the gate 35. This signal CHR is outputted as "0" from the CPU 2 when correcting at the recording time. Further, the latch data of the latch 28 outputted from the gate group 31 are supplied to the latch 11 at the time of correcting the data at the reproducing time.

Figure 9:
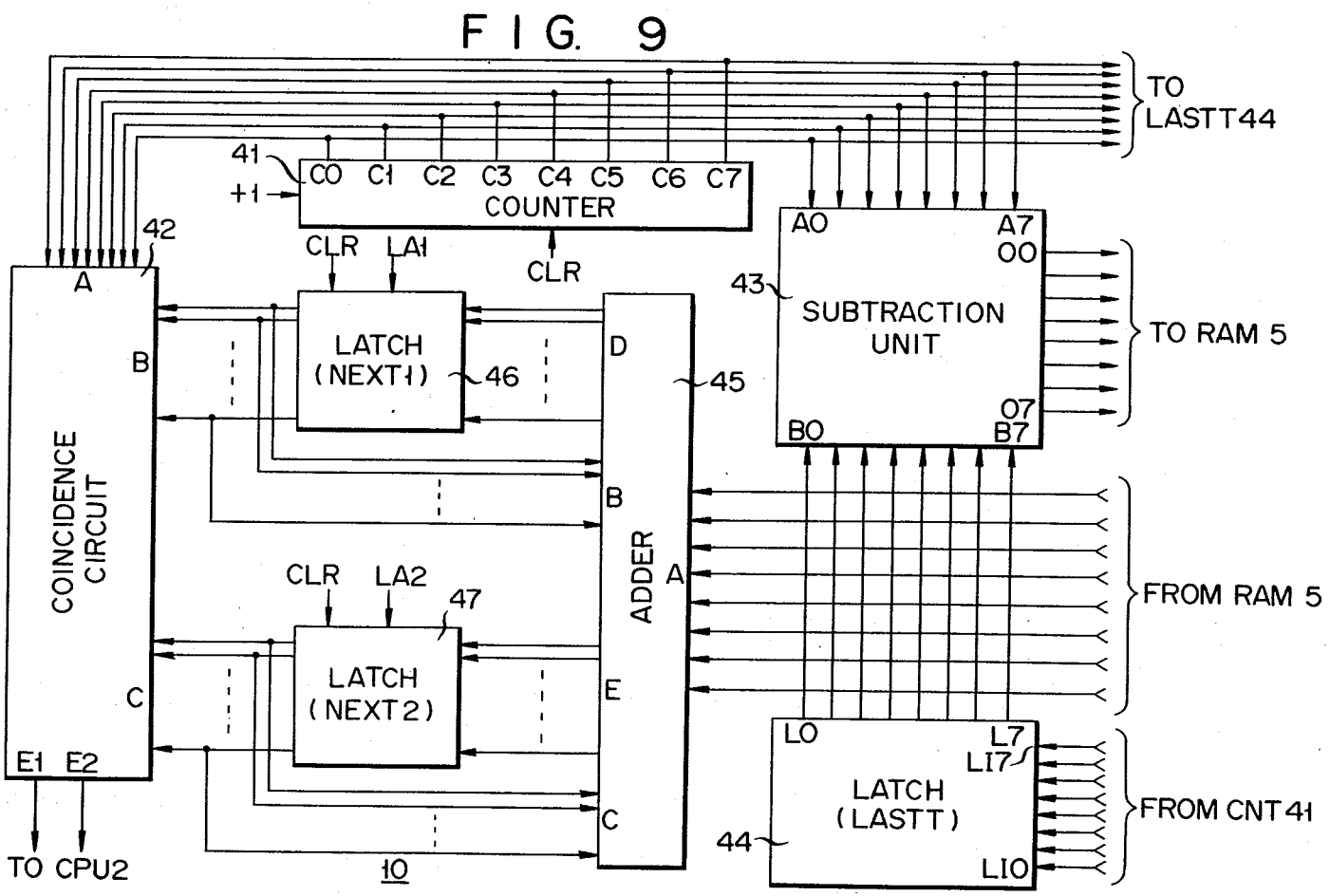
FIG. 9 is a block diagram showing an example of a circuit arrangement of a mix down unit in FIG. 1.

Referring now to FIG. 9, the concrete arrangement of the mix down unit 10 will be described. A counter (which will be abbreviated "CNT") 41 is cleared by the clear signal CLR outputted from the CPU 2 when the CPU 2 starts processing the mix down operation, and executes counting of +1 signal outputted from the CPU 2 and inputted to the counter 41. The counter 41 has a capacity of 8 bits, the counted output of the counter 41 is inputted as time data to the A input terminal of a coincidence circuit 42, the A input terminals A7 to A0 of a subtraction unit 43 and the LI input terminals LI7 to LI0 of a latch 44 (which will also be abbreviated to "LASTT"). The latch data of the latch 44 is applied through the L output terminals L7 to L0 to the B input terminals B7 to B0 of the subtraction unit 43. The subtraction unit 43 subtracts the input data to the A input terminals by the input data to the B input terminals and outputs the time data of the difference from D output terminals D7 to D0, thereby writing as one synthetic data in the designated channel in the RAM 5.

Time data read out from two mixed-down channels in the RAM 5 are applied to the A input terminal of an adder 45. Time data for latching a latch (which will be also abbreviated to "NEXT1") 46 for one of the two channels and time data for latching a latch (which will be also abbreviated to "NEXT2") 47 for the other of the two channels are respectively inputted to the B input terminal and the C input terminal of the adder 45. The adder 45 adds the input data to the A input terminal and the input data to the B input terminal or the input data to the C input terminal, and outputs as new time data the resultant data from a D output terminal or an E output terminal, thereby latching the data to the latch 46 or 47. The latches 46 and 47 respectively execute the latching operations when the CPU 2 outputs signals LA1 and LA2. The latches 46 and 47 are cleared together with the counter 41 by the clear signal CLR outputted from the CPU 2 at the time of starting the mix down process.

The latch data of the latches 46 and 47 are respectively applied to the B input terminal and the C input terminal of the coincidence circuit 42. The coincidence circuit 42 detects the coincidence or non-coincidence of the input data to the A input terminal to the input data to the B input terminal in response to the inputted latch data, outputs a coincidence signal E1 to the CPU 2 and detects the coincidence or non-coincidence of the input data to the A input terminal to the input data at the C input terminal, and outputs a coincidence signal E2 to the CPU 2.

Figure 3A:
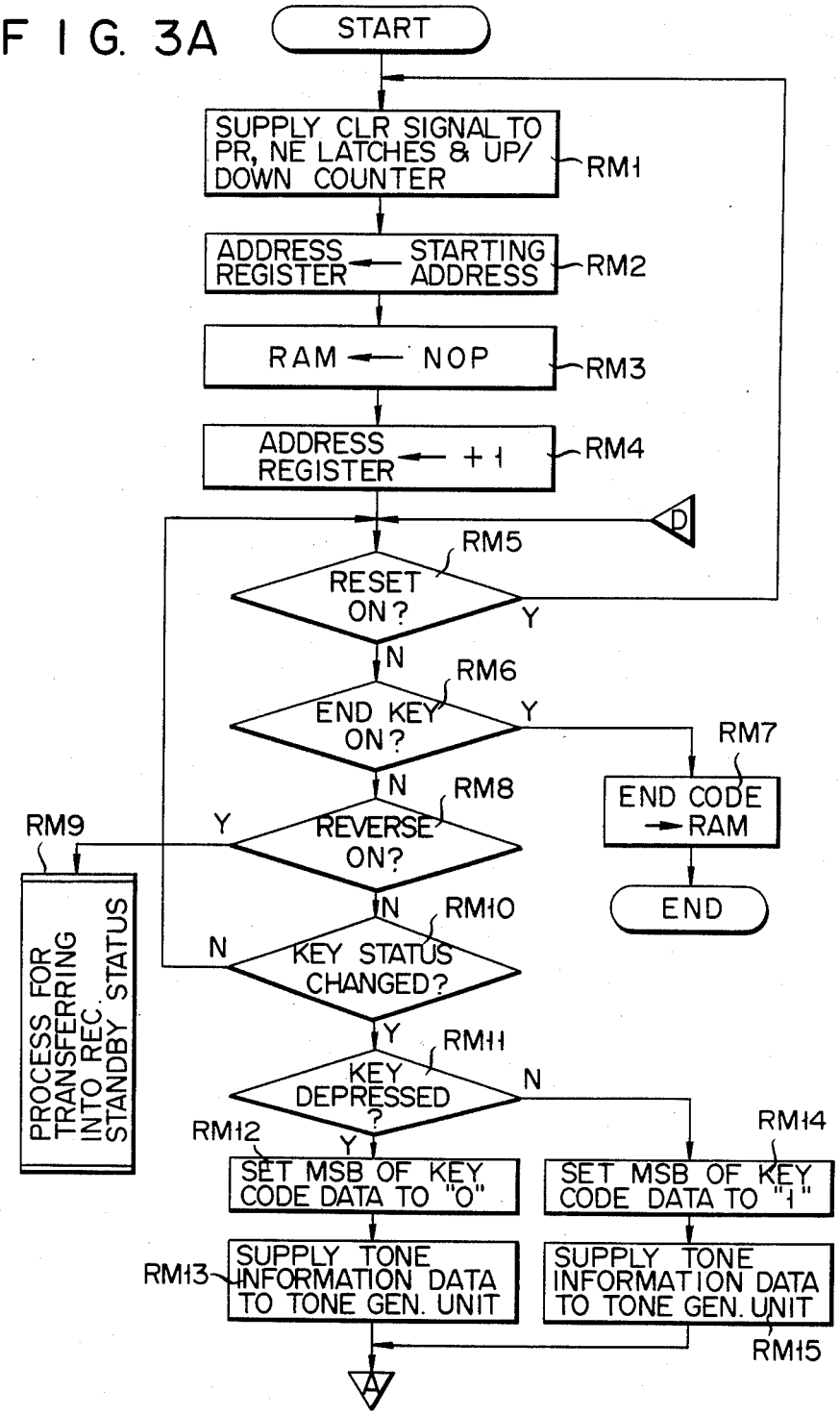
FIGS. 3A and 3B are flow charts showing the recording process of melody information in the embodiment.
Figure 3B:
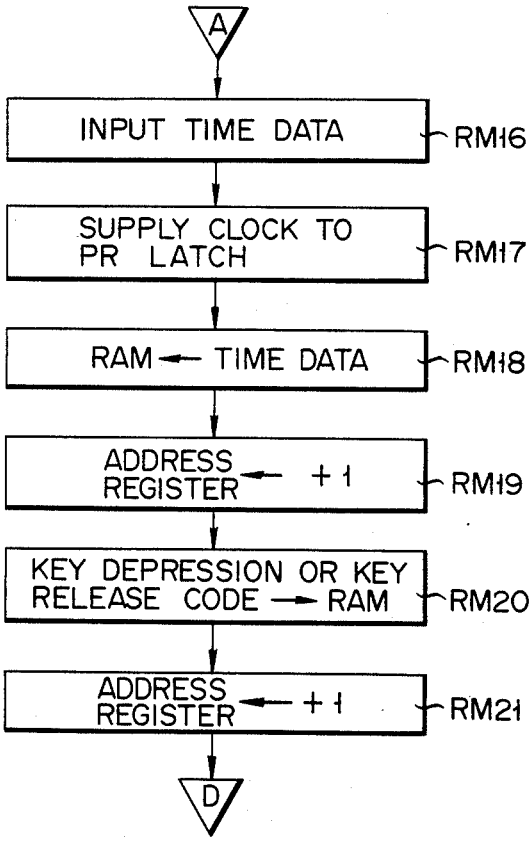
Figure 8:
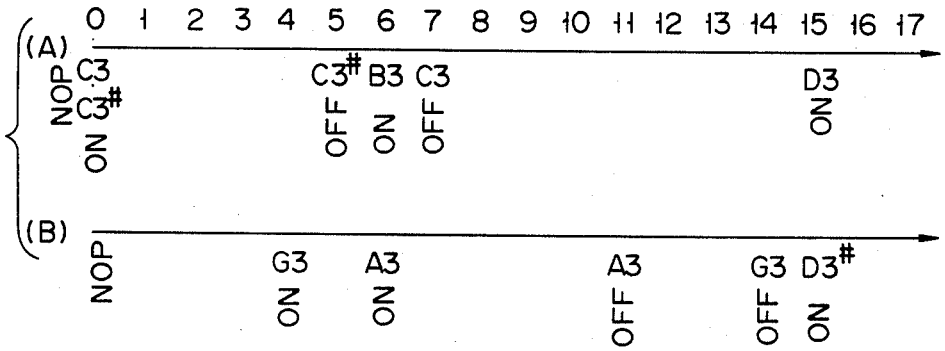
FIG. 8 is a view showing melody information of two types similarly to a music score.

The recording and reproducing operations of two music pieces of melody progress in the RAM 5 shown in FIGS. 8(A) and 8(B) will be described. The recording operation will be first described. In this case, melody information of the above music in FIG. 8(A) is first recorded by the keying operation of the keyboard switch unit 1. FIGS. 3A and 3B show flow charts for describing the recording operation of the melody information. In FIG. 8, numerals 0 to 17 designate the counted output of the counter 41.

Figure 4:
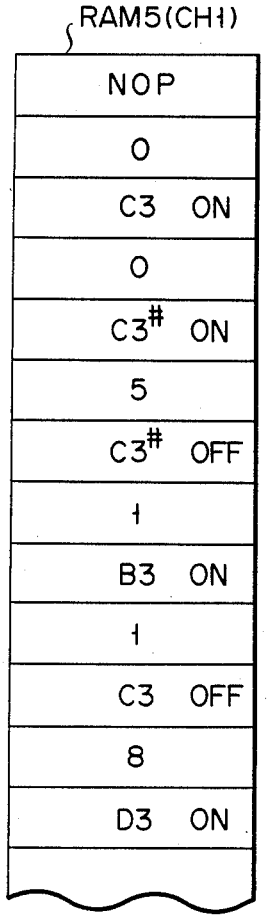
FIG. 4 is a view showing the stored state of the melody information stored in the channel 1 (CH1) of a RAM 5.

In starting recording of the melody information, a record start switch (not shown) of any of the channels (e.g., first channel (CH1)) is turned ON. The output of the switch is inputted to the CPU 2 through the bus line B2. The CPU 2 processes the step RM1 of the flow charts in FIGS. 3A and 3B in response to the input of the CPU 2. In other words, the CPU 2 outputs a clear signal CLR to the bus lines B7 and B9, thereby respectively clearing the PR latch 11, NE latch 28 and up/-down counter 17. Then, the CPU 2 outputs and sets address control information for setting the starting address of the melody information of the music in FIG. 8(A) in the address register unit 7 to the address counter for the first channel (CH1) in the RAM 5 to be written through the bus line B5 (in step RM2). Subsequently, the CPU 2 outputs data NOP through the bus line B6, thereby writing the data in the starting address (0 address) of the CH1 in the RAM 5. FIG. 4 shows the model of the stored state. The data NOP (NO OPERATION) is data similar to pause and which does not play tone generation. The operation described above is a process in step RM3. Thereafter, the CPU 2 executes the incrementing process of step RM4 for adding +1 to the address counter (which will be hereinafter merely substituted for an address register) of the address register unit 7, thereby setting an address 1. Then, a process of judging "is the reset switch 1A ON?" occurs in step RM5. The reset switch 1A is turned ON when correcting the recording. When the reset switch 1A is turned ON, the process is returned to the step RM1, and set to the initial state. On the other hand, when not ON, the process is advanced to step RM6, which judges "is the end key 1D ON?". The end key 1D is turned ON when the input of the melody information is finished, thereby writing an end code at the last of the melody information inputted to the RAM 5. When the end key 1D is turned ON (Y "yes"), the process is advanced to step RM7, which executes the above-described process. Since the end key 1D is not, however, turned now ON (N "no"), the process is advanced to step RM8, which judges "is the reverse switch 1B (reverse switch ASW) ON?". When the reverse switch 1B is ON, a process for transferring into record standby status is executed in step RM9, which will be described in detail later. The reverse switch 1B is not now ON, and the process is advanced to step RM10, which judges "is key status changed?". The steps RM10, RM5, RM6, RM8, RM10, . . . are repeated during the period until the melody performance of a chord is started from when two keys of the two first tones (tones of pitches C3 and C3#) of the melody in FIG. 8(A) are turned ON simultaneously upon the record start switch. When the keys of the tones C3 and C3# are simultaneously turned ON, the process is advanced to step RM11, which judges "is key depressed?". Since the key is depressed, the process is advanced to step RM12, which judges "is the MSB of key code data set to "0"?". The CPU 2 first executes the process for setting the MSB (the most significant bit) of the key code data to "0" to indicate the key code of the pitch C3 at the low tone side and the depressed key data, and calculates the tone information. The CPU 2 supplies the tone information data to the tone generation unit 3 through the bus line B3, thereby starting the speakers 6R and 6L to generate tones (in step RM13). Then, the process is advanced to step RM16, the CPU 2 sets the signal CH to "0", thereby normally opening the transfer gate group 12 at the following normal time, and normally closing the transfer gate group 13. Thus, after the CPU 2 clears the above-described step RM1 in the reproducing unit 9, the CPU 2 inputs a clock of the set tempo, thereby inputting as the data TD7 to TD0 the counted output (time data) of the up/down counter 17 which is already up counting the clock of the tempo (in which the switch BSW is now turned ON, the flip-flop 26 is set, and the counter 17 is now up counting) to the PR latch 11 and the A input terminal of the subtraction unit 14, through the bus line B11 and the transfer gate group 12. Thereafter, the subtraction unit 14 subtracts the input data to the A input terminal by the input data from the PR latch 11 to the B input terminal, and supplies as time data the difference to the CPU 2. Step RM17 is executed to supply a clock signal LAT to the PR latch 11 by the CPU 2. At this time the inputting data is latched to the latch 11, thereby holding the latched data thereafter and applying the data to the B input terminal of the subtraction unit 14. Subsequently, the process is advanced to stem RM18, which writes the resultant data I7 to I0 being "0" in the address 1 of the RAM 5, since the input data to the terminals of the subtraction unit 14 are equal. Then, +1 is added to the address register, thereby setting an address 2 (in step RM19), in which the key depression or key release code already calculated in the address 2 of the RAM 5, i.e., the key code (C3) and the key depression data ("ON"), are written (in step RM20). Then, +1 is added to the address register, thereby setting an address 3 (in step RM21), and the process is returned to the step RM5.

Then, the process of the key for the pitch C3# which is turned ON simultaneously by the processes of the steps RM5, RM6, RM8, RM10 to RM13, RM16 to RM21 is similarly executed, time data "0" is written in the address 3 of the CH1 in RAM 5, and the key code (C3#) and the key depression data ("ON") are written in the address 4. Thereafter, an address 5 is set in the address register, and the process is returned to the step RM5. Then, two tones of pitch C3 and C3# are simultaneously generated as a chord.

Subsequently, when the key release operation of the key of the pitch C3# is judged in step RM10 through the steps RM5, RM6, RM8, the process is advanced to step RM14, which executes to set the MSG of key code data to "1" to indicate the key code of the pitch C3# and the key release data, thereby generating a key release code. The tone information data is supplied to the tone generation unit 3, thereby erasing the tone of pitch C3# (in step RM15). When the process is advanced through the step RM16 to step RM17, time data of the counter 17 is newly latched to the latch 11 at the time of key release operation, then held, and applied to the B input terminal of the subtraction unit 14. The subtraction unit 14 subtracts the time data inputted to the A input terminal at the key release time by time data upon key depression of the key for the pitch C3# which is inputting to the B input terminal to produce the resultant data, and writes the time data in the address 5 in the RAM 5 (in step RM18). In this case, as shown in FIG. 4, the time data at this time is "5". As shown in FIG. 4 by the processes of the steps RM19 and RM20, the key release code is written in an address 6 of the RAM 5. An address 7 is designated in step RM21, and the process is returned to the step RM5.

When the key for the pitch B3 of the second tone is then depressed, this is judged in step RM10, the process is advanced through step RM11 to step RM12, the key depression code is calculated similarly to the key depression time of the pitches C3 and C3#. Then, the tone of the pitch B3 is started to be generated by the process of step RM13. The time data at the key depression time of the pitch B3 is latched to the latch 11 by the processes of the steps RM16, RM17 and RM18. The subtraction unit 14 subtracts the time data at the key depression time of the pitch B3 to the A input terminal by the time data at the key release time of the pitch C3# to the B input terminal, thereby producing the resultant data and writing the data in an address 7 in the RAM 5. In this case, as shown in FIG. 4, the time data by the resultant data is "1". After the process in the step RM20, a next address 9 in the RAM 5 is designated in step RM21, and the process is returned to the step RM5.

In this manner, when the performance of a melody is carried out at a time interval according to FIG. 8(A), melody information after D3 of third tone is written in the address followed by 9 of the CH1 in the RAM 5, by a process similar to the above-described process. When the last performance input is finished, the end key 1D is turned ON, and the end code is written as the last data of the melody information in the RAM 5.

Then, the process of step RM9 when the reverse switch 1B is turned ON will be described. This reverse switch 1B (reverse switch $A_{SW}$) operates to turn ON when the keying operation is mistaken at the time of inputting the melody information, to back the address register unit 7 to the desired address and to set the correct melody information in record enable standby status. In this case, the latch data of the latch 11 at the time of turning the reverse switch 1B ON is latched through the CPU 2 to the NE latch 28 of the reproducing unit 9.

As described above, after the melody information in FIG. 8(A) is written in the CH1 of the RAM 5, the melody information of a music in FIG. 8(B) is written in the second channel (which will be abbreviated to "CH2") of the RAM 5 while reproducing and listening to the melody information in FIG. 8(A). The recording process of this case (i.e., the process of the flow charts in FIGS. 3A and 3B) is similar to that described above, with the result that the melody information of the music in FIG. 8(B) is written in the state shown in FIG. 7 in the CH2 of the RAM 5.

Figure 6A:
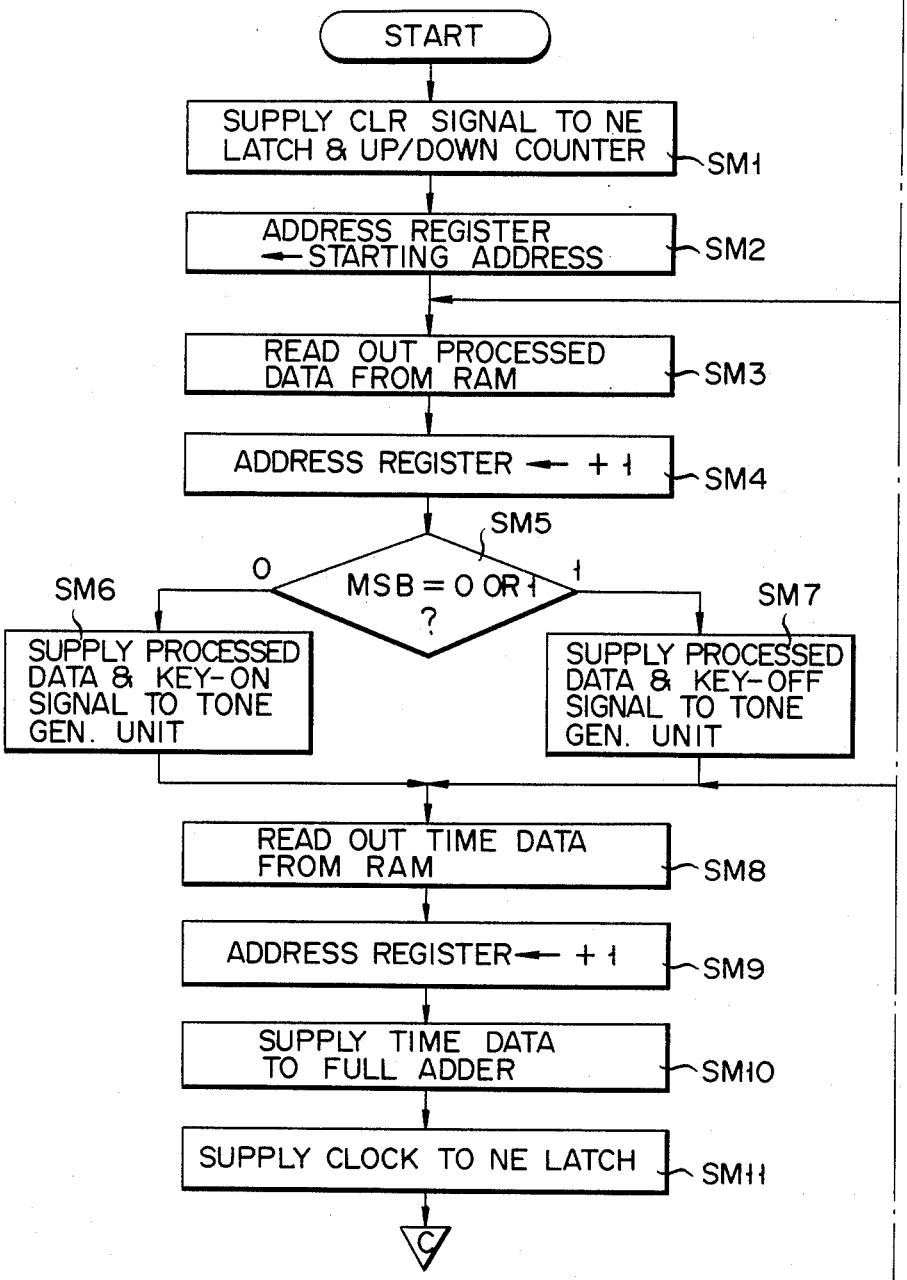
FIGS. 6A and 6B are flow charts showing the reproducing process of melody information in the embodiment.
Figure 6B:
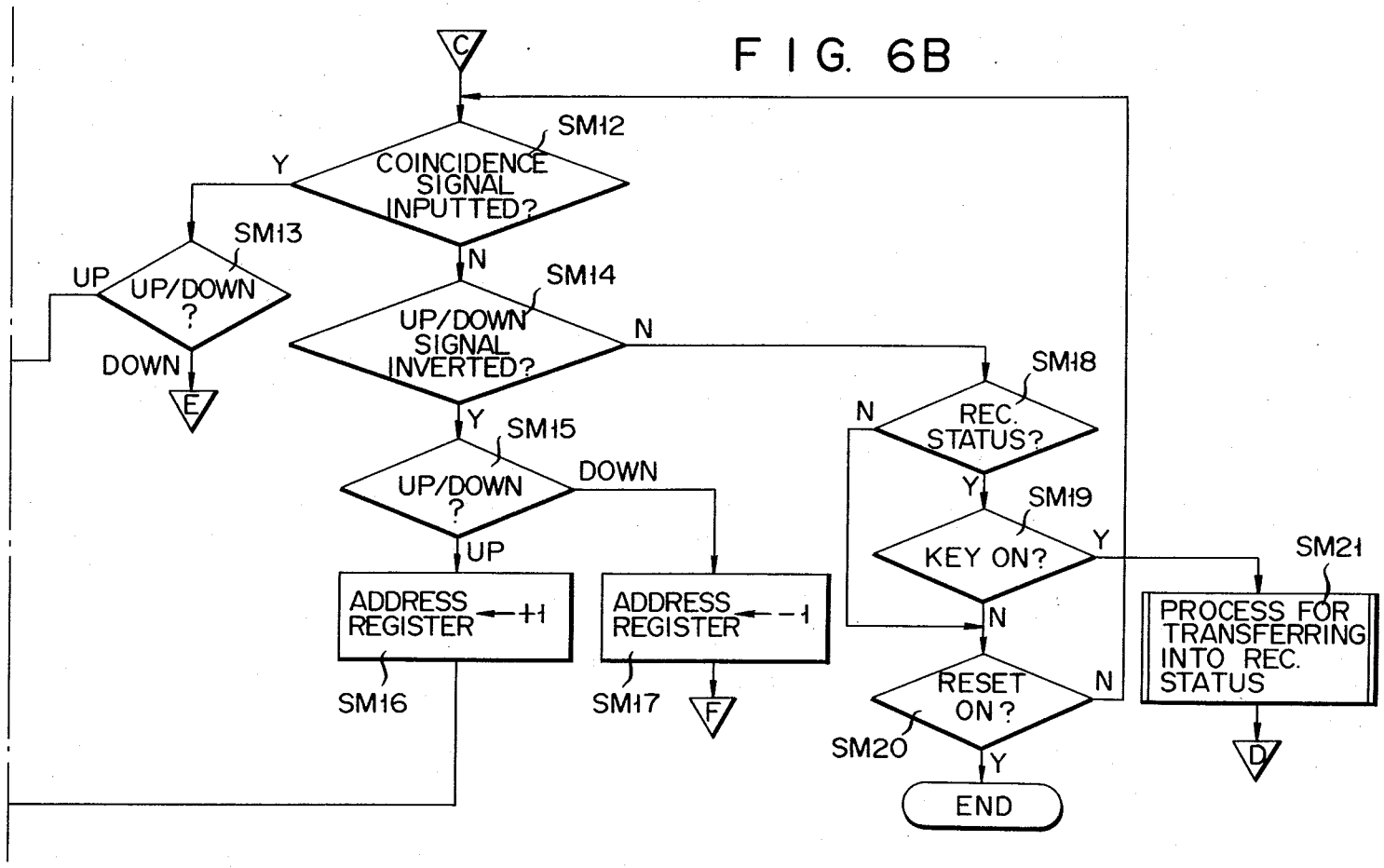

Therefore, the reproducing process of the melody will be first described with reference to the flow charts in FIGS. 6A and 6B.

Figure 5A:
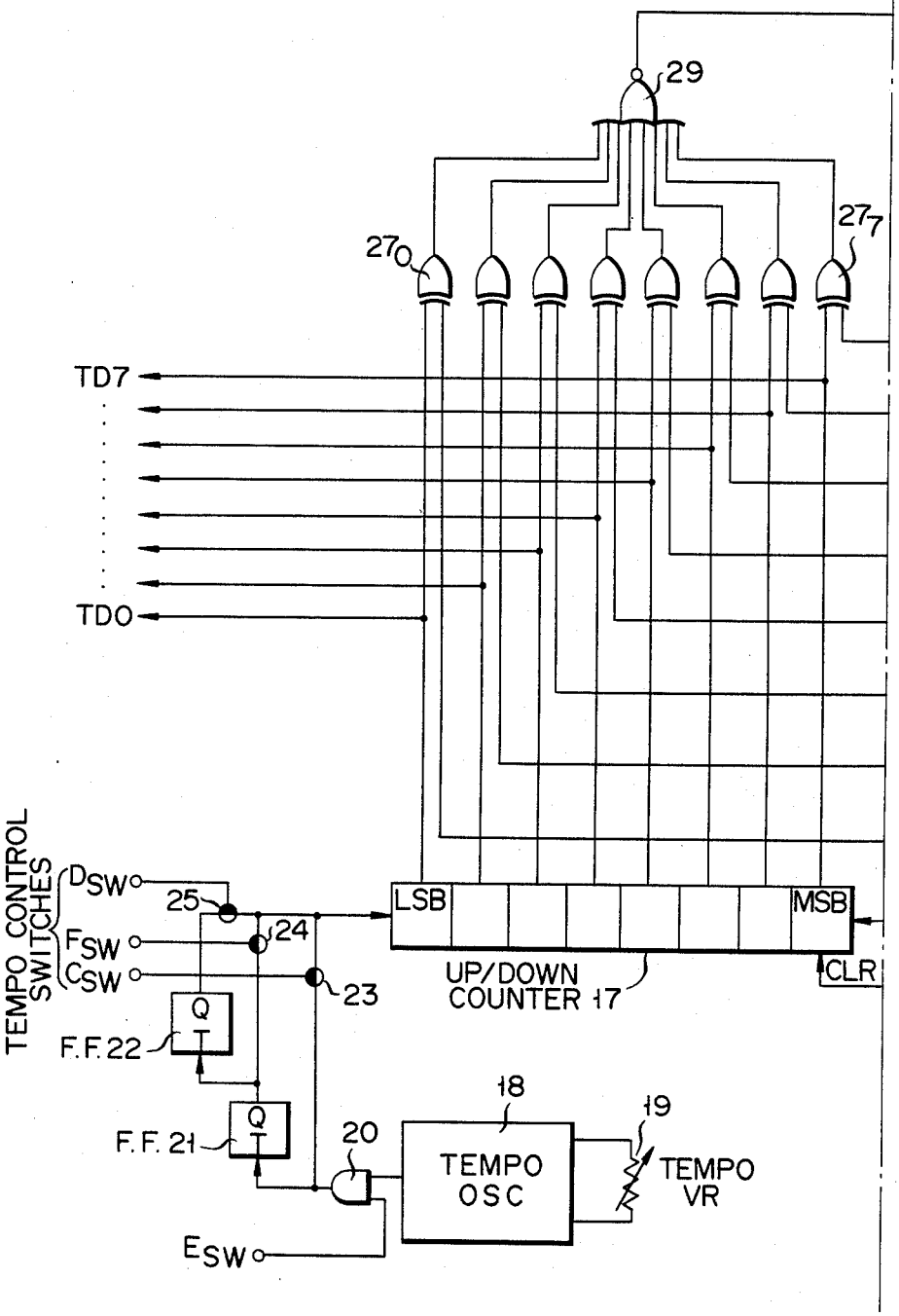
FIGS. 5A and 5B are block diagrams showing an example of the circuit arrangement of a reproducing unit shown in FIG. 1.
Figure 5B:
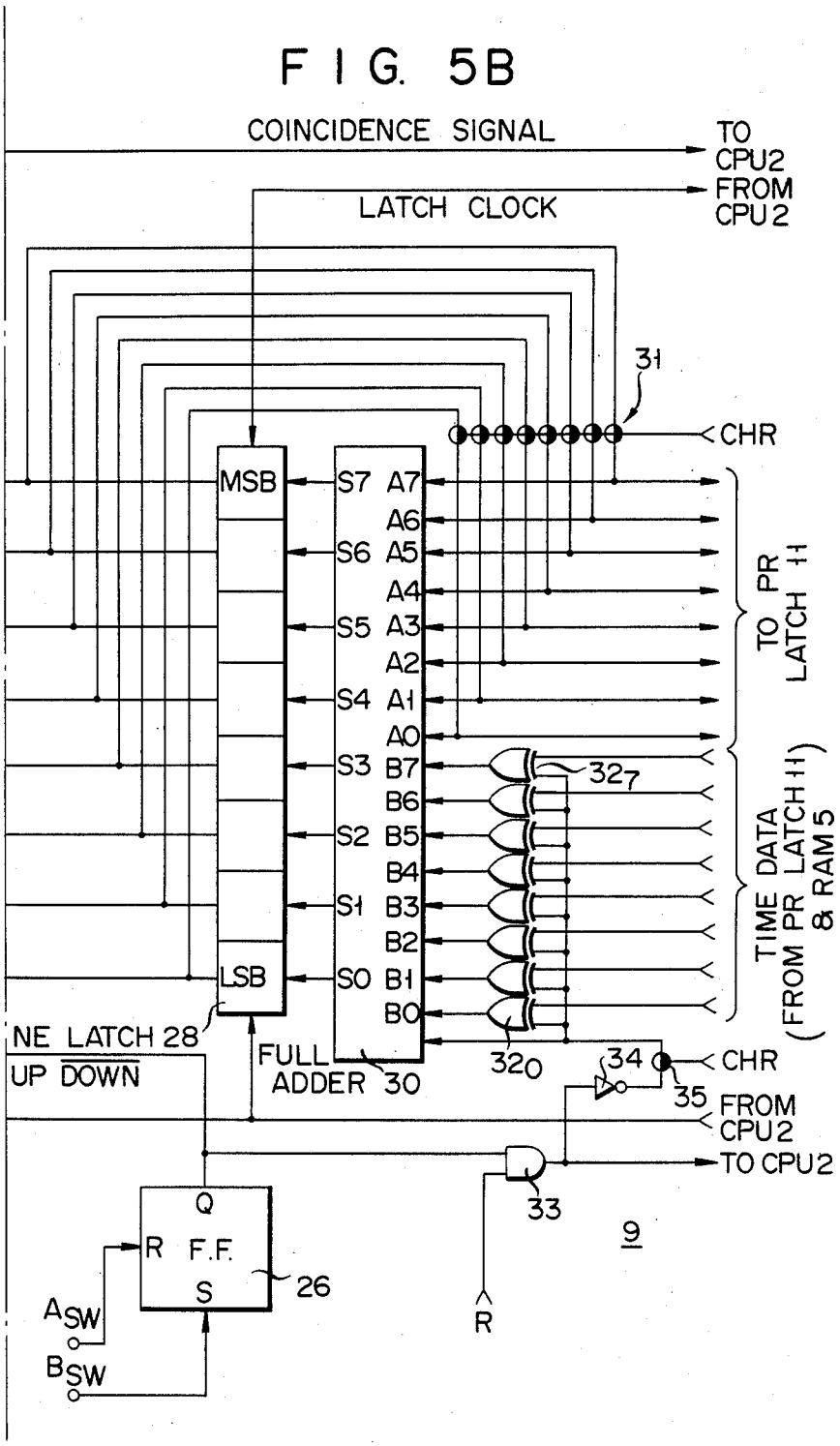

When a reproduction switch (not shown) for CH1 of the RAM 5 is first turned ON, a clear signal is supplied to the NE latch 28 and up/down counter 17 in FIGS. 5A and 5B in the process in step SM1, thereby clearing the latch 28 and counter 17. Then, the starting address for the melody information in FIG. 8(A) written in the CH1 of the RAM 5 is set in the address register unit 7 by the process in step SM2. The processed data "NOP" (in FIG. 4) is read out from the RAM 5 and supplied to the CPU 2 (in step SM3). Then, +1 is added to the address register unit 7, thereby sett4ing an address 1 (in step SM4). Subsequently, the CPU 2 judges "is the MSB of the data "NOP" "0" or "1"?" in step SM5, in which the data "NOP" is similar to pause, and the process is advanced to step SM7, which supplies processed data and a control signal corresponding to key-OFF signal to the tone generation unit 3, thereby inhibiting the execution of tone generation. When the process is advanced to step SM8, the CPU 2 reads out the time data "0" from the address 1 in the RAM 5, and +1 is added to the address register unit 7 to set an address 2 (in step SM9). The time data "0" from the address 1 is inputted to the B input terminal of the full adder 30, and the resultant data is latched to the NE latch 28 (in steps SM10 and Sm11). In this case, the switch BSW is now turned ON, with the result that the flip-flop 26 is in a set state and the AND gate 33 is opened, and the up/down counter 17 is instructed to up count. The signal R is outputting normally as "1", and the output of the AND gate 33 is accordingly normally "1", which is supplied to the CPU 2, and the output of the inverter 34 becomes normally "0", which is supplied to one terminals of exclusive OR gates $32_7$ to $32_0$ and the carry input terminal CIN of the full adder 30 through the transfer gate 35. The signal CHR is outputted normally as "1", and the transfer gate 35 and the transfer gate group 31 are accordingly normally opened.

Therefore, in steps SM10 and SM11, the time data "0" is not inverted by the gates $32_7$ to $32_0$, but inputted as it is to the B input terminal of the full adder 30. On the other hand, the output data (8 bit all "0" data) of the NE latch 28 are inputted to the A input terminal through the transfer gate group 31 and the resultant data of the full adder at that time becomes "0", which is latched to the latch 28.

Then, in step SM12, the process judges "is coincidence signal from the NOR gate outputted at level "1"?". In this case, 8 bit all "0" data of the up/down counter 17 and the 8 bit all "0" latch data of the latch 28 are respectively inputted to the exclusive OR gates $27_7$ to $27_0$, the coincidence signal of "1" level is accordingly supplied to the CPU 2, and the process is advanced to step SM13, which judges "up counting" and the process is advanced to step SM3.

Subsequently, in step SM3, the key code "C3" and key depression data "0", i.e., the data "C3, ON" in FIG. 4 are read out from the address 2 in the CH1 of the RAM 5, inputted to the CPU 2, and an address 3 is set in the CH1 of the RAM 5 in step SM4. In step SM5, the process judges the key depression data "0", the process is then advanced to step SM6, which supplies processed data, the key code "C3" and key-ON signal to the tone generation unit 3, with the result that the tone of the pitch C3 of the first one of the melody in FIG. 8(A) is first reproduced, thereby allowing the speakers 6R and 6L to generate tones. Then, in step SM8, the time data "0" is read out from the address 3 in the CH1 of the RAM 5, and the address 4 of the RAM 5 is set in step SM9. The time data "0" is applied to the B input terminal of the full adder 30 as it is. On the other hand, the latching time data "0" is inputted by the latch 28 to the A input terminal of the full adder 30, and the resultant added data of the full adder 30 at that time is equal to the time data "0", newly latched to the latch 28, and added to the gates $27_7$ to $27_0$ (in step SM11). The process is then advanced to step SM12, which judges "is the coincidence signal inputted at level "1"?". Since the coincidence signal is outputted at level "1", the process is advanced through step SM13 to the step SM3. In the step SM3, the data "C3#, ON" in FIG. 4 are read out from the address 4 of the CH1 in the RAM 5, an address 5 of the CH1 of the RAM 5 is set in step SM4, and the tone of the pitch C3# of the first tone is started to be generated as a chord simultaneously with the tone of the pitch C3 in steps SM5 and SM6. In the processes of steps SM8 to SM11, the time data "5" is read out from the address 5 of the CH1 of the RAM 5, applied to the B input terminal of the full adder 30 as it is, the time data "0" is inputted to the A input terminal at that time, and the resultant time data 5 is accordingly newly latched to the latch 28. Further, an address 6 of the CH1 of the RAM 5 is set. The process is then advanced to step SM12, and again advanced first to step SM14 in the meantime while the coincidence signal of "1" level is outputted, in which step SM14, the process judges "is up/down signal inverted?", and hence, in this case, "is the reverse switch ASW turned ON?". Since the switch ASW is not turned ON but "NO", the process is advanced to step SM18, which judges "is the melody information correction recording?". Since the judgment is "NO", the process is further advanced to step SM20, which judges "is the reset switch 1A ON?". Since the judgment is "NO", the process is returned to step SM12. These processes are repeated.

When the time corresponding to the time data "5" is elapsed from the start of the simultaneous tone generation of the first tone of the key codes "C3", "C3#" and the coincidence signal of "1" level is outputted, the process is advanced to step SM13, then to step SM3, and the key code "C3#" and the key release data "1", i.e., the data "C3#, OFF" in FIG. 4 are read out from the address 6 in the RAM 5. Further, in the step SM4, an address 7 is set in the RAM 5. In the step SM5, the key release data "1" is judged, the process is then advanced to step SM7, which supplies the key code "C3#" and the key-OFF signal to the tone generation unit 3, and the tone of the pitch "C3#" of the first tone is stopped generating from the speakers. Then, in step SM8, the time data "1" is read out from the address 7 of the RAM 5, and an address 8 is set in the RAM 5 in step SM9. In steps SM10 and SM11, the time data "1" is inputted to the B input terminal of the full adder 30 as it is, and since at that time the time data "5" of the previous resultant data is inputted to the A input terminal, the resultant added data outputted from the full adder 30 becomes "6", which is newly latched to the NE latch 28, and applied to the exclusive OR gates $27_7$ to $27_0$. Then, the process is advanced to step SM12, in which the above-described steps SM14, SM18, SM20, SM12, . . . are repeated during the time until the counted value of the up/down counter 17 is counted up to the time data "6", and in the meantime, the tone of the pitch "C3#" of the first tone is erased, but only the tone of the pitch "C3" is generated. Further, when the coincidence signal of "1" level is outputted, the process is advanced to step SM13, and to step SM3.

As described above, two first tones of the chord are completely reproduced, and the reproducing process for the second tone B3 is thereafter started in the same manner as described above. When the first tone is reproduced as described above, the performance is carried out in accordance with the process in FIG. 8(B), and the melody information of the music is inputted to the CH2 of the RAM 5.

Figure 10A:
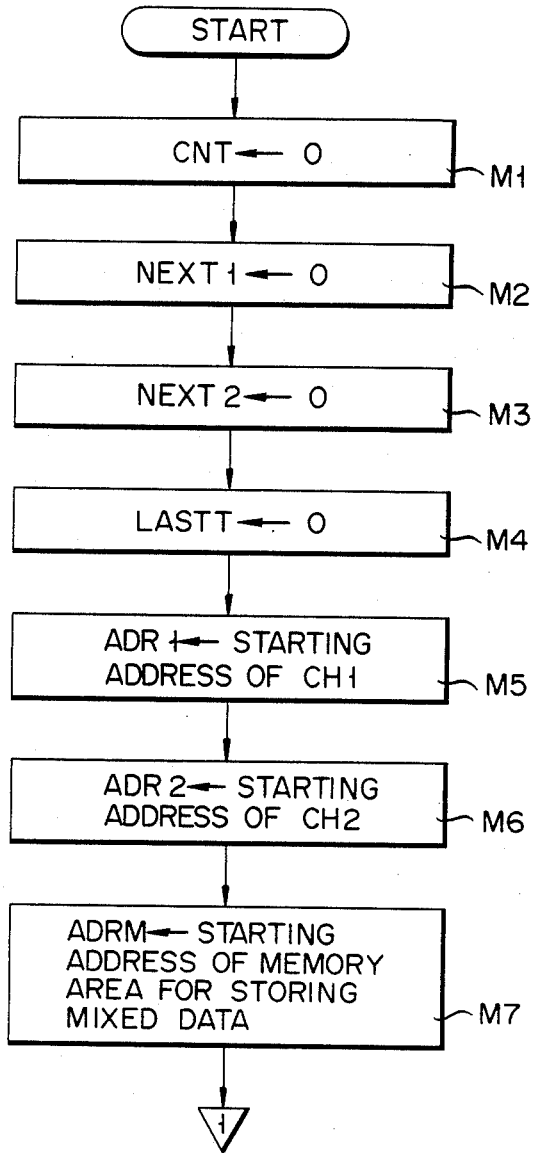
FIGS. 10A and 10B are flow charts showing the mix down process.
Figure 10B:
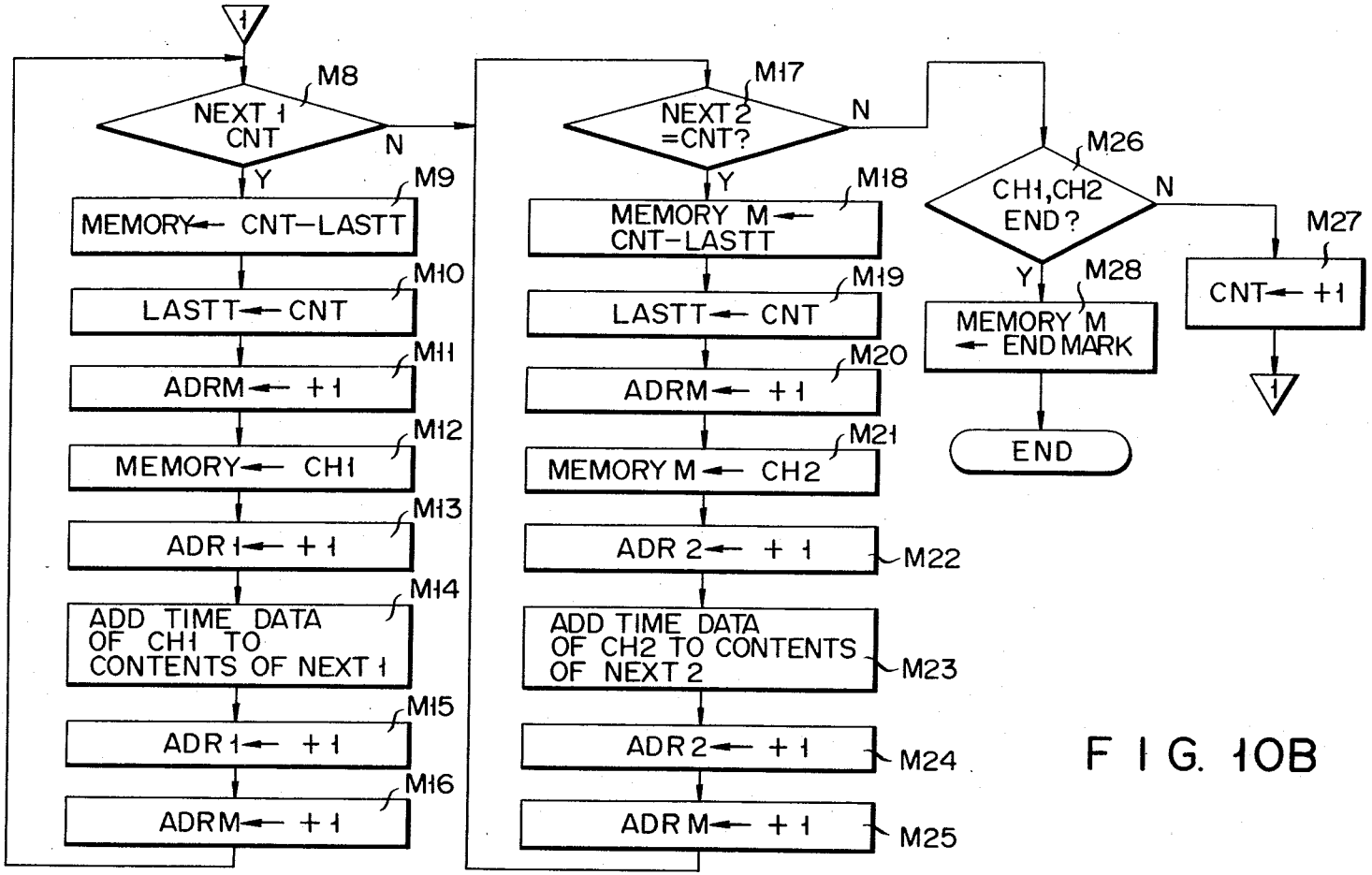

In this manner, two music pieces in FIGS. 8(A) and 8(B) thus recorded in the CH1 and CH2 of the RAM 5 are synthesized by the mix down process of the mix down unit 10, and the process by which the synthesized music is, for example, recorded in the area of third channel (which will be abbreviated to "CH3") of the RAM 5 will be described. FIG. 10 shows the flow chart of this process.

Figure 11:
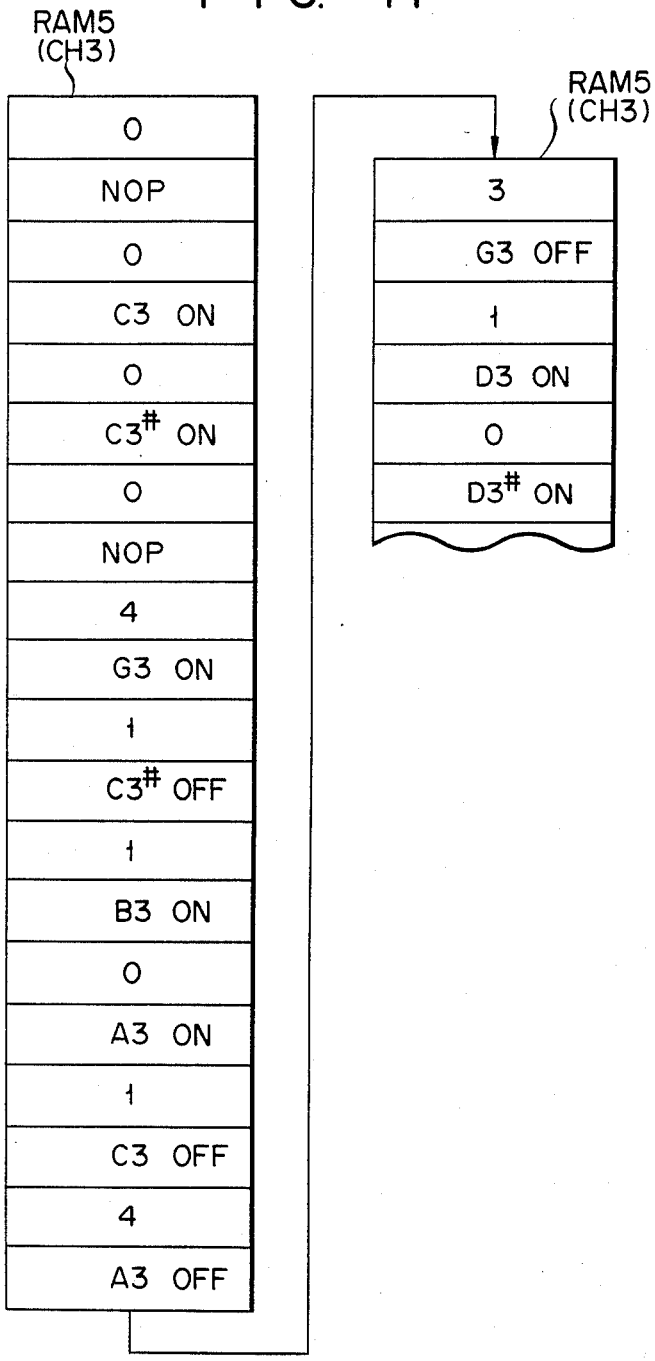
FIG. 11 is a view showing the stored state of tone information stored in the channel 3 (CH3) of the RAM after the mix down.
Figure 12B:
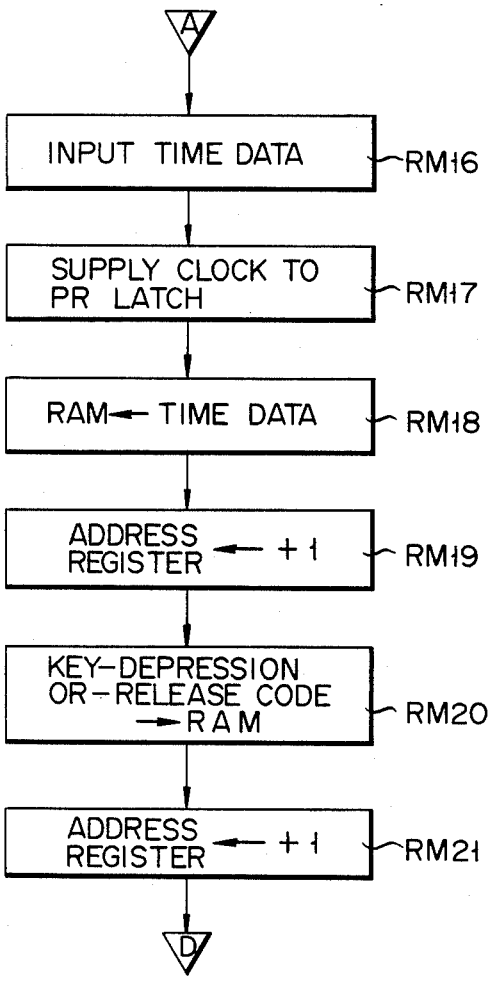
Figure 13:
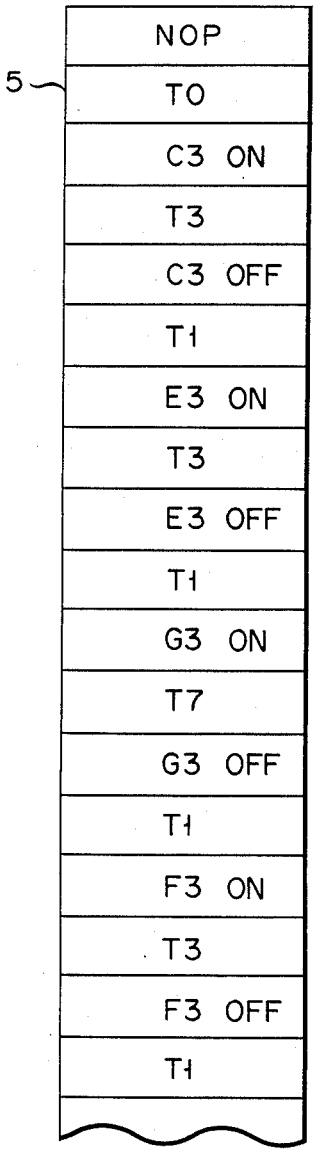
FIG. 13 is a view showing the stored state in the RAM of melody information shown in FIGS. 15(A) and 17(A)
Figures 1, 14A:
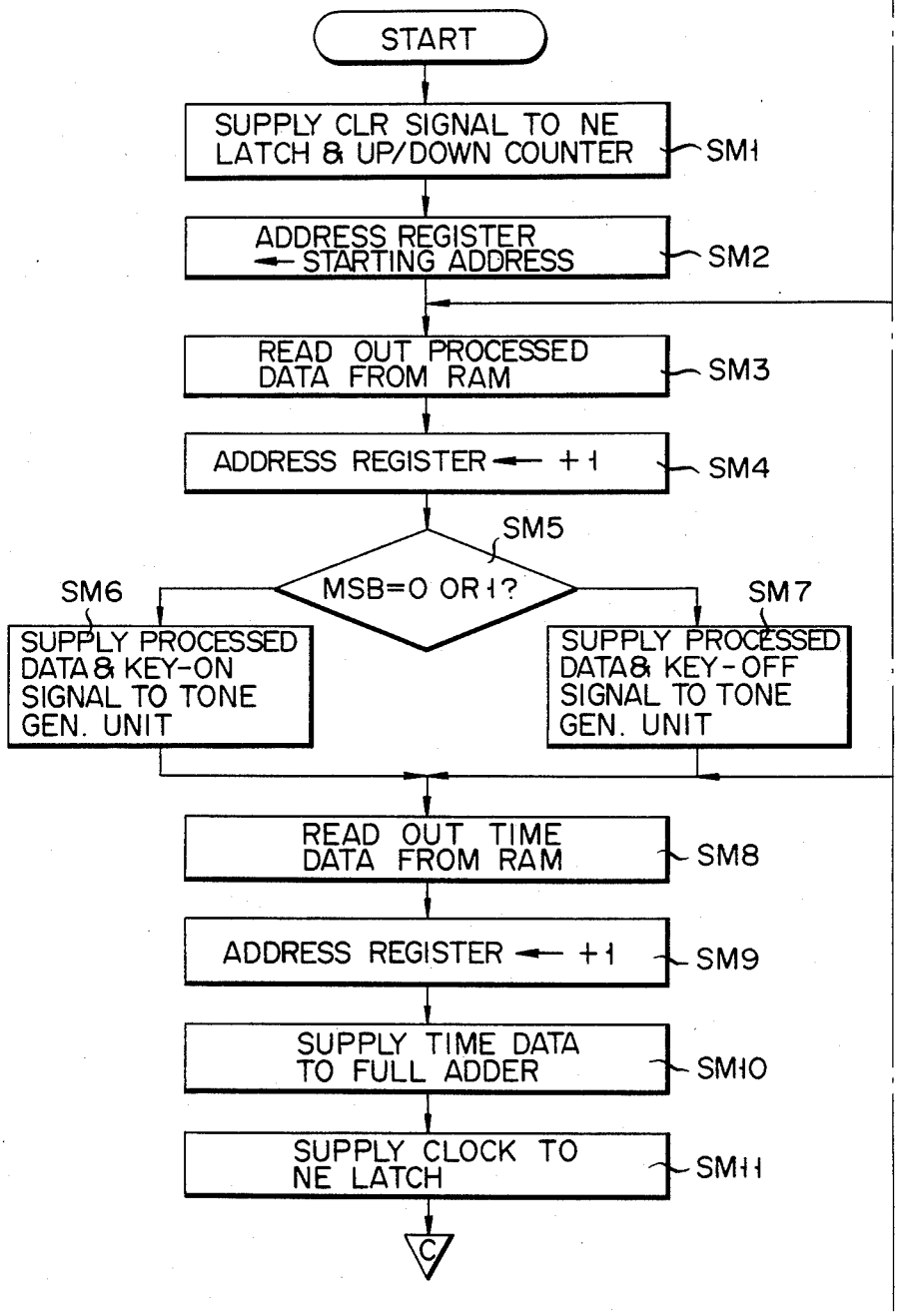
Figure 14C:
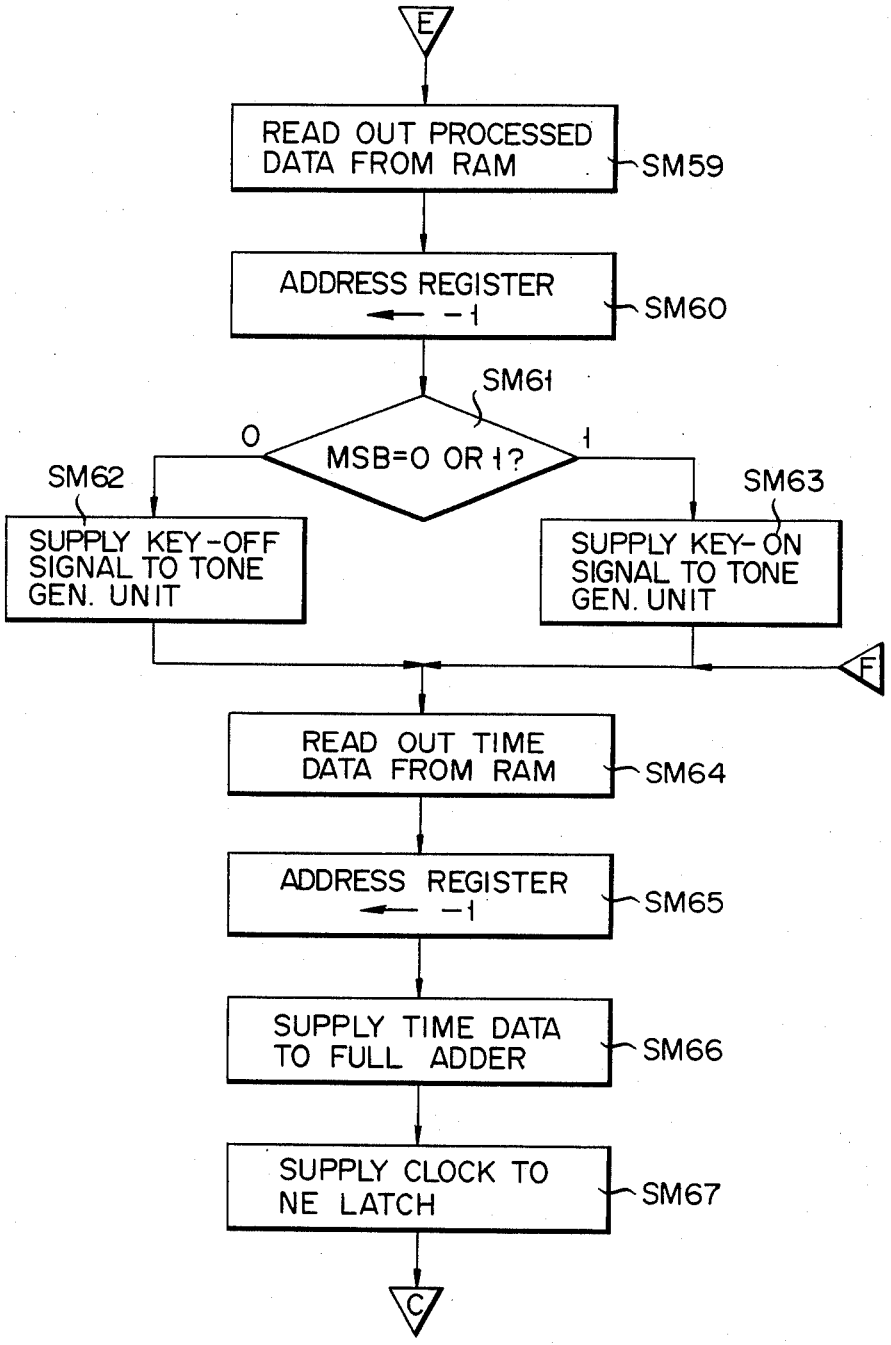

When the switch for the mix down process is first turned ON, steps M1, M2, M3 and M4 of the flow chart in FIG. 10 are sequentially executed, and the counter 41, the latch (NEXT1) 46, the latch (NEXT2) 47 and the latch (LASTT) 44 are all reset by the clear signal (in FIG. 9). Then, in steps M5 and M6, starting address (address 0) is preset in the address counter (abbreviated to "ADR1") of the CH1 and the address counter (abbreviated to "ADR2") of the CH2 in the address register unit 7. Then, in step M7, a starting address is set in an address counter of the CH3 (abbreviated to "ADRM"). Subsequently, in next step M8, the coincidence circuit 42 judges "is the data of the latch 46 coincident to the counted output of the counter 41?". Now, both data are "0", and the coincidence signal E1 of "1" level is outputted and supplied to the CPU 2. Therefore, the CPU 2 starts processing in step M9, thereby writing the resultant data of the subtraction unit 43, i.e., the data "0" produced by subtracting the counted output "0" of the counter 43 by the data "0" of the latch 44 in the area of the address of the CH3 as shown in FIG. 11. Then, the counted output "0" of the counter 41 is set in the latch 44, and held as the data of previous time (in step M10). In step M11, +1 is added to the ADRM, thereby setting an address 1, the data "NOP" of the address 0 by the ADR1 of the CH1 is read out and written in the address of the CH3 (in step M12). Then, +1 is added to the ADR1, thereby setting the address 1 (in step M13), the time data "0" of the address 1 of the CH1 of the RAM 5 is read out and applied to the A input terminal of the adder 45, which adds the time data "0" to the time data "0" of the latch 46 to the B input terminal, and the resultant time data "0" is again latched to the latch 46 (in step M14). Thereafter, +1 is added to the ADR1, thereby setting an address 2 (in step M15), +1 is then added to the ADRM, thereby setting an address 2 (in step M16). Then, the process is returned to the step M8.

In this manner, in step M8, the process judges "there is still an output of a coincidence signal E1 of "1", and the process is then advanced to step M9, and the resultant subtracted data "0" of the subtraction unit 43 is written in the address 2 of the CH3 of the RAM 5. Then, the counted output "0" of the counter 41 is again latched in the latch 44 (in step M10), +1 is added to the ADRM, thereby setting an address 3 (in step M11). Thereafter, in step M12, the data "C3, ON" from the address 2 of the CH1 is read out and written in the address 3 of the CH3, +1 is added to the ADR1, thereby setting an address 3 (in step M13). Then, in step M14, the latch data "0" of the latch 46 is added by the adder 45 to the time data "0" of the address 3 of the CH1, and the resultant time data "0" is produced, and latched to the latch 46. Then, in step M15, the ADRl becomes an address 4, and in step M16, the ADRM becomes an address 4. Then, the process is returned to the step M8.

In the step M8, the process judges the output of the coincidence signal E1 of "1" level. Since the output is coincident, the process is again advanced to the step M9. In the steps M9, M10, the resultant data "0" of the subtraction unit 43 is written in the address 4 of the CH3 of the RAM 5, and the data "0" is again latched to the latch 44. Thereafter, in steps M11, M12, an address 5 is set, and the data "C3#, ON" from the address 4 of the CH1 is read out and written in the address 5. Subsequently, +1 is added to the ADR1, thereby setting an address 5 (in step M13). In next step M14, the time data "5" from the address 5 of the CH1 is read out in the latch 46, added to the time data "0" of the latch 46, and the resultant data "5" is latched to the latch 46. Then, in steps M15, M16, the ADR1 and ADRM are together set in an address 6, and the process is returned to the step M8.

In this step M8, since the data of the counter 41 is not coincident to the data of the latch 46, the process judges the coincidence signal E1 of "0", and is advanced to step M17. In the step M17, the process similar to the step M8 is executed for the CH2 of the RAM 5, i.e., the coincidence circuit 42 judges the coincidence of the counted output "0" of the counter 41 to the latch data "0" of the latch 47, outputs the coincidence signal E2 of "1" to the CPU 2. In this manner, the CPU 2 instructs the advance to step M18. In this case, the following steps M18, M19, M20, M21, M22, M23, M24 and M25 respectively correspond to the steps M9, M10, M11, M12, M13, M14, M15 and M16 of the CH1, and similar processes are executed to the CH1 for the CH2.

Figure 7:
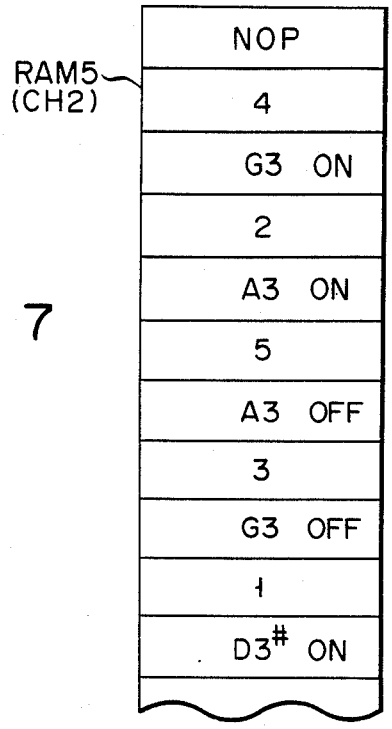
FIG. 7 is a view showing the stored state of melody information stored in the channel 2 (CH2) of the RAM 5.

More particularly, in step M18, the resultant data "0" of the subtraction unit 43 is written in the address 6 of the CH3 of the RAM 5, in step M19, the data "0" is again latched to the latch 44. In steps M20, M21, the data "NOP" from the address 0 of the CH2 shown in FIG. 7 is read out and written in the address 7 of the CH3 of the RAM 5. Then, +1 is added to the ADR2, thereby setting an address 1 (in step M22). In step M23, the time data "4" of the address 1 of the CH2 is read out, and added to the data "0" of the latch 47 in the adder 45, and the resultant data "4" is latched to the latch 47. Then, in step M24, M25, an address 2 is set in the ADR2, and an address 8 is set in the ADRM, and the process is returned to the step M17.

In step M17, since the data "0" of the counter 41 is not coincident to the latch data "4" of the latch 47, the coincidence signal E2 of the "1" is judged, the process is then advanced to step M26, which judges "are data ends in CH1 and CH2?" in accordance with the presence or absence of the end codes of the respective channels. Since the channels are not now data end, the process is advanced to step M27, +1 signal is outputted to the counter 41 from the CPU 2, thereby setting the counted output to "1". Then, the process is returned to the step M8.

In the step M8, the process judges the incoincidence of the counted output "1" of the counter 41 to the latch data "0" of the latch 46, the process is then advanced to the step M17, in which the incoincidence is judged, the process is then advanced to step M26, and to step M27, which adds +1 to the counter 41 to "2", and the process is returned to the step M8.

The steps M8, M17, M26, M27 are twice executed in the meantime until the value of the counter 41 becomes coincident to the data "4" of the latch 47. Then, when the value of the counter 41 becomes "4", the coincidence is detected in step M17 through the step M8, and the resultant subtracted difference "4" of the data "4" of the counter 41 from the data "0" of the latch 44 is written in the address 8 of the CH3 of the step M18. In step M19, the present value "4" of the counter 41 is set to the latch 44. Then, in steps M20, M21, the data "G3, ON" from the address 2 of the CH2 is written in the address 9 of the CH3 of the RAM 5, +1 is further added to the ADR2, thereby setting an address 3 (in step M22). In step M23, the time data "2" of the address 3 of the ADR2 is added to the data "4" of the latch 47, and the resultant data "6" is set in the latch 47. Then, after the processes of steps M24, M25, M17, M26 and M27, the process is returned to the step M8.

The following operation is the repetition of the above-described operation, and synthetic data is written in the CH3 of the RAM 5 as the respective melodies of the music pieces in FIGS. 8(A) and 8(B). The result is shown in FIG. 11. In step M26, when the data end of the CH1, CH2 are judged, the process is advanced to step M28, the end mark is written at the last of the data of the CH3, and the mix down process is finished. Numerals 0, 1, . . . in FIGS. 8(A) and 8(B) designate counted values of the counter 41.

In the embodiments described above, the number of channels of the memory for storing the melody information is 3. However, the number of the channels may be equal to and more than 4. The memory may not employ a plurality of channels in one memory, but may individually use a plurality of channels. Further, when the content of the memory area is mixed down to store tone information in one memory area, the tone information of the other memory area may be stored in the memory area for storing the tone information of the base by adjusting the timing information.

As described above, when a plurality of tones of tone information to be simultaneously generated are stored in memory means, an automatic music playing apparatus which can record and reproduce, for example, a chord is provided by storing the tone information which contains time data representing that the tone generation timings are simultaneous. Further, since the automatic music playing apparatus of the invention is constructed so that tone information from other area is transferred to and stored in one area of the memory means, the chord can be recorded and reproduced in memory areas of much less number such as areas of one memory means, and the recording input operation is simple.

When pieces of tone information from respective areas of the memory means are synthesized, an advantage such that no difficulty occurs even if a plurality of pieces of tone information are superposed at the same time, is provided.

Further, since tone information is inputted to another area of memory means while the tone information stored in a certain area of the memory means is read out and a corresponding tone is generated when the tone information is inputted to memory means, the automatic music playing apparatus of the invention has an advantage that the inputting operation is readily understandable.

The embodiment shown in FIG. 1 has a pause key 1E in the keyboard switch unit 1, and has a function for correcting tone information temporarily stored in memory means. The correcting operation will be described with reference to FIGS. 12A, 12B to FIGS. 19A, 19B.

When tone information is recorded in the RAM 5 of the memory in FIG. 1, a recording process is performed in accordance with the flow charts in FIGS. 12A-I, 12A-II and 12B, but the process is similar to that in FIGS. 3A and 3B except the process which is carried out in response to the operation of the pause key 1E, the same step numbers are designated in the corresponding steps, and the steps will be omitted in description.

In FIG. 12A-I, when the fact that the end key 1D is not ON is detected in step RM6, the process is advanced to step RM30, which judges "is the pause key 1E ON?". This pause key 1E is provided for temporarily stopping a recording or reproducing operation. When the pause key 1E is turned ON, the process is advanced to step RM31*a*, which stops the counting operation of the up/-down counter 17. In other words, the input of a clock to the counter 17 is inhibited by the CPU 2. The judging process (in step RM31*b*) of the OFF of the pause key 1E is repeated during the time until the pause key 1E is turned OFF, and the counting operation remains stopped in the meantime. When the OFF operation is judged, the stopping state of the counting operation is released in step RM32, and the process is then advanced to step RM8.

In the step RM8, the process judges "is reverse switch 1B (reverse switch ASW) ON?". When the reverse switch 1B is turned ON, the process is transferred to record standby state in the steps after step M33. When the reverse switch 1B is turned OFF, the processes similar to those in FIGS. 3A and 3B after the steps RM10 are carried out.

When the keying operation is mistaken at the time of inputting melody information, a reverse switch 1B is turned ON. The address register 7 is backed to the desired address in response to the ON of the reverse switch 1B, and correct melody information is set in record enable standby state.

Figure 15:
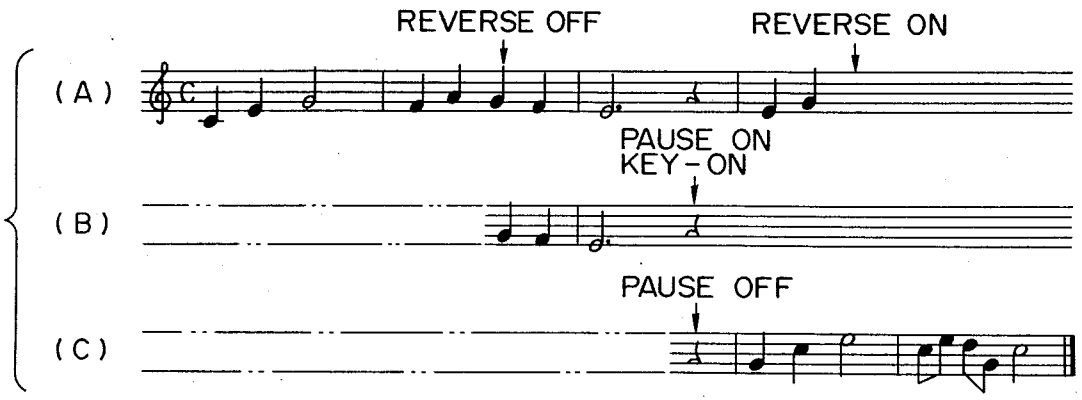
FIGS. 15 and 17 are views showing music to be recorded and an editing method.

For example, assume that data "G3, ON" representing the key depression code of the G3 key is written in the address 38 of the RAM 5, as shown in the third stage from the lowermost stage in FIG. 16A, after the key of the tenth tone G3 in FIG. 15 is turned ON and it is observed immediately after the above operation that the G3 key is erroneously inputted. At this time the reverse key 1B is immediately turned ON. FIG. 15(A) shows this, and the second tone G3 in fourth measure is erroneously keyed, the reverse key 1B is immediately turned ON, and the third tone is not inputted to the measure.

The ON operation of the reverse switch 1B is judged in step RM8, and the process is then advanced to step RM33. The flip-flop 26 is reset by the ON operation of the reverse switch 1B, a down count command is inputted to the up/down counter 17, which thus starts down counting. Then, the AND gate 33 is closed, the output "0" of the gate 33 is supplied to the CPU 2, and the output of the inverter 34 is inverted to "1". The time data "T3" representing the key-ON time of the key G3 is outputted from the subtraction unit 14 into the CPU 2 in step RM33, and written in address 39 of the RAM 5 (in step RM34). In step RM35, +1 is added to the address register unit 7, threby setting an address 40, the CPU 2 outputs an end mark to the address and writes it (in step RM36). Then, the address register 7 is subtracted by 2, thus backing to the address 38 (in step RM37), and the signal CHR is then temporarily outputted as "0" (in step RM38). At that time, the time data latched to the PR latch 11 is supplied through the CPU 2 to the exclusive OR gates $32_7$ to $32_0$ of the reproducing unit 9 (in step RM39). Since the signal CHR is not "0", the time data from the latch 11 is inputted to the B input terminal of the full adder 30 as it is, and since the transfer gate group 31 is closed, the data from the NE latch 28 is cut from the A input terminal and inputted to all "0" data to the terminal. In other words, the time data from the latch 11 is latched to the latch 28 in response to the all "0" data input as it is, and the time data is accumulated to the cumulative value up to the key-ON time of the tenth tone (in step RM40). The process is then advanced to step RM41, and the signal CHR is returned to "1". Subsequently, the process is advanced to reproducing flow in step SM12 in FIGS. 14A-I to 14C. In the step SM12, the process judges "is coincidence signal outputted as "1"?", i.e., "is the counted output of the up/down counter 17 down from the time data during up counting when the reverse switch 1B is turned ON to the time data of the NE latch 28?", namely, "is it rewound?", and steps SM14, SM15, SM23, SM24, SM25, SM12, . . . are repeated during the time until coincidence is obtained. More particularly, the process judges "is the reverse switch 1B again operated to be transferred from the present down counting state to up counting state?" (in step SM14), "is the record switch lC turned ON to become recording status?" (in step SM18), "is the pause key 1E turned ON to set the pause status?" (in step SM23), "is the key for correcting turned ON?" (in step SM24), and "is the reset switch 1A turned ON to be set in reset status?" (in step SM25). When the output of the coincidence signal of "1" is judged in step SM12, the process is advanced to step SM13. Since it is now down counting, the process is advanced to step SM59 to be described later in FIG. 14C. In this step SM59, the key depression code of the key G3 is read out from the address 38 of the RAM 5. Then, the process is advanced to step SM60, 1 is subtracted from the address register unit 7, thereby setting an address 37. In step SM61, the key depression code is judged, the process is then advanced to step SM62, which executes a tone erasing process, thereby starting the erasing of the tenth tone G3. Subsequently, in step SM64, the time data "T1" of the key-OFF time of the ninth tone E3 is read out from the address 37, and the address 36 is set (in step SM65). In step SM66, the time data (key-OFF time) is applied as full bit inverted data from the signal CHR of "1" and the output of the inverter 34 "1" to the B input terminal of the full adder 30, while the latch data of the NE latch 28 is applied to the A input terminal, and since the input to the carry input terminal CIN is "1", the full adder 30 executes subtraction, thereby subtracting the input data to the A input terminal by the input data to the B input terminal, and the resulting data is outputted to the latch 28 and latched to the latch 28 (in step SM67).

Then, the process is returned to step SM12, steps SM14, SM18, SM23, SM24, SM25, SM12, . . . are repeated in the meantime until the coincidence signal of "1" is outputted upon lapse of the key-OFF time ("T1") of the ninth tone E2, and the tone is erased. When the coincidence signal of "1" is outputted, the process is advanced to step SM13, further to step SM59, and the key release code "E3, OFF" of the ninth tone E3 is read out from the address 36 of the RAM 5. Then, in step SM60, the address 36 is set, and in step SM61, the key release code is judged, the process is then advanced to the step SM63, which generates the ninth tone E3, thereby starting the generating of the tone. Subsequently, the time data "T3" of the key-ON time of the ninth tone E3 is read out from the address 35 in step SM64, and in step SM65, the address 34 is set. Thereafter, in steps SM66, SM67, the full adder 30 subtracts, and the resulting data is latched to the NE latch 28. Then, the process is returned to the step SM12.

Tone process for the ninth tone E3 is executed in the same manner as described above, and the correcting position is confirmed while listening to the reproducing and generating tone during rewinding in this manner. It is assumed that when read out from the address 24 of the RAM 5 as shown, for example, by the key release code of the sixth tone G3 in FIG. 16A and rewound to the position of generating the tone, the reverse switch 1B is turned OFF as shown in FIG. 15(A). The OFF of the reverse switch 1B is judged through step SM12 in step SM14, and the process is advanced to step SM15, which judges "the inversion to the up counting operation". In other words, the flip-flop 26 is returned to set state by the OFF of the reverse switch 1B, an up count command is inputted to the up/down counter 17, and the AND gate 33 is opened. Then, the process is advanced to step SM15, and +1 is added to the address register, thereby setting an address 23. The process is then advanced to step SM3, the time data "T3" is read out from the address 23, the address 24 is set in step SM9, the time data "T3" is applied to the full adder 30 as it is (in step SM10), and the full adder 30 adds the latch data from the NE latch 28, i.e., the cumulative time data from the first tone C3 up to the key-ON time of the sixth tone G5 and the time data. The resultant data is latched to the NE latch 28 (in step SM11), and the process is returned to the step SM12. The steps SM12, SM14, SM18, SM23, SM24, SM25, SM12, . . . are repeated in the meantime until the coincidence signal ("1") is outputted, and the sixth tone G3 is generated in the meanwhile. When the coincidence signal of "1" is then outputted, the process is advanced to step SM13, and the key release code "G3, OFF" (in FIG. 16A) of the sixth tone G3 is read out from the address 24 of the RAM 5. Subsequently, in step SM4, the address 25 is set in the address register unit 7, then in step SM6, the key depression code is judged, the process is then advanced to step SM7, which erases the sixth tone G3. The process is then advanced to step SM8, the key-OFF time data "T1" of the sixth tone G3 is read out from the address 25 of the RAM 5, and next address 26 is set in step SM9. In next steps SM10, SM11, new cumulative data by the adding operation of the full adder 30 is latched to the NE latch 28, and the process is returned to step SM12.

Steps SM12, SM14, SM18, SM23, SM24, SM25, SM12 are similarly repeated in the meantime until the key-OFF time of the sixth tone G3 is elapsed, i.e., until the coincidence signal of "1" is outputted, and the tone is erased. When the coincidence signal of "1" is outputted, the key depression code of the seventh tone F3 is read out from the address 26 of the RAM 5 by the processes in steps SM13, SM3, SM4 and SM5, and the process is judged, and the process is advanced to step SM6, which generates the tone. In steps SM8 to SM11, the key-OFF time data "T3" of the seventh tone F3 is read out from the address 27, the cumulative time data newly added with the data "T3" is latched to the NE latch 28, and the process is returned to the step SM12. The seventh tone F3 is generated during the time while the processes of the above-described steps SM12, SM14, SM18, SM23, SM24, SM25, SM12, . . . are repeated. When the key-ON time is elapsed, the process is advanced to step SM12, which transfers to the tone erasing process of the seventh tone E3. The tone erasing process for the seventh tone E3 is executed in the same manner as the sixth tone G3. As shown in FIG. 15(B), assume that the pause key 1E is turned ON at the time when the key-OFF time of the eighth tone E3 is elapsed to become a pause, and the correcting recording is started.

More particularly, the ON of the pause key 1E is judged in step SM23, the process is then advanced to step SM39, which stops supplying a clock to the up/-down counter 17, thereby stopping the counting of the counter 17, and stopping supplying a clock to the rewind up/down counter 17, thereby stopping the counting of the clock and stopping the reproducing and tone generating. The steps SM40, SM41 are repeated so long as the key is not then turned ON while the pause key 1E is ON, thereby continuing the ON operation state of the pause key 1E. When the pause key 1E is turned OFF, the OFF of the pause key 1E is judged in step SM43, and the up/down counter 17 restarts up counting (in step SM44). Subsequently, the process is advanced to step SM45, which subtracts 1 from the address register unit 7, thereby setting an address 33. The full adder 30 temporarily subtracts by the processes in steps SM46, SM47 and SM48, thereby subtracting the cumulative time data T48 from the NE latch 28 to the addresses 1 to 33 by the time data T4 from the address 33 of the RAM 5 and producing the resultant data T44, which is latched to the latch 28. In step SM49, the signal R is returned to normal "1", and the full adder 30 is thereafter operated to add. In next steps SM50, SM51, the latch data "T44" to the latch 28 is supplied to the latch 11 and latched to the latch 11.

In step SM52, the signal CH is returned to the normal "0" state. Since the MSB of the processed data (the key-OFF of the eighth tone E3) read out from the RAM 5 is "1", the process is advanced to step RM95 in FIG. 12A. Then, the steps RM5, RM6, RM12, RM13, RM5, . . . are repeated until the ninth tone G3 for correction is keyed-ON. When the ninth tone G3 is keyed-ON after the predetermined time as shown in FIG. 15(C), the process is advanced to step RM15, and further to step RM16 to RM24. Accordingly, the subtracted result of the subtraction unit 14 is written in the address 33 of the RAM 5, i.e., the key-OFF time "T4" of the eighth tone E3 is written therein. The key depression code of the ninth tone G3 is written in the address 34, the address 35 is set, the process is then again advanced to the step RM5, and the tenth tone C4 and eleventh tone E4, . . . are operated by key in the same manner as described above, and sequentially recorded.

Figure 17:
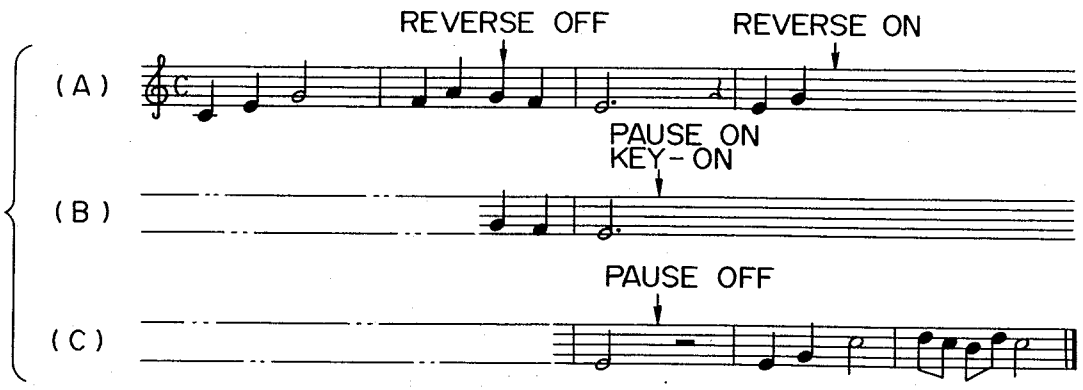

FIGS. 17(A) to 17(C) show the correction of another content on the same music sheet in FIG. 15, while FIGS. 18A and 18B show the contents corresponding in the RAM 5. As seen in FIG. 17(A), the operation wherein the reverse switch 1B is turned ON for rewinding during recording of the tenth tone G3, and the reverse switch 1B is turned OFF by the sixth tone G3, is in the same manner as that shown in FIG. 15. It is then assumed that, when the eighth tone E3 is reproduced for 2 beats after listening to the reproduced tone of the sixth tone G3 and seventh tone F3 after the reverse switch 1B is turned OFF, the pause key 1E is turned ON as shown in FIG. 17. This fact is then judged in step SM23, the process of step SM39 is executed, and the up/down counter 17 is stopped. When the pause key 1E is turned OFF after te key of C3 is turned ON, the MSB of the processed data (the key-ON of the eighth tone E3) read out from the RAM 5 is judged as "0" through the steps SM44, . . . , SM53 after through the steps of SM40 and SM43, and the process is advanced to step SM54. Therefore, the subtracted result of the subraction unit 14 is written in the address 33 of the RAM 5, i.e., the key-ON time of the eighth tone E3 is corrected from T12 to T8 (from half-note with dot to half-note). Then, in step SM3, the address 34 is designated, the key-OFF code of E3 is written in step SM56, and erased. Subsequently, the time when pause switch 1E is turned OFF is latched to the PR latch 11, and the address 35 is designated (in steps SM57, SM58). Thereafter, the process is advanced to step RM5 in FIG. 12A, and then the ninth tone E3 and tenth tone G3, . . . are operated to match the start of the fourth measure in the same manner as that described above, thereby sequentially recording the tones.

As shown in FIGS. 15(A), 15(B) and 15(C), even if the rewinding operation is executed by the operation of the reverse switch 1B in the course of recording and the keying operation for correction (ninth tone G3) is executed to match the start of the fourth measure without operating the pause key 1E in the course of reproducing the generating of the tone, the process can be immediately transferred to the recording state. In other words, the key-ON is judged in step SM24, and the process is advanced to step SM25. Then, the steps SM27 to SM33 are processed, thereby executing the correcting operation. In other words, the steps SM26 to SM33 operate in the same manner as the steps SM43 to SM52, and the operation will be omitted in description. In step SM34, the subtracted result is written in the address 33 of the RAM 5, the address 34 is designated in step SM35, the key-ON code of G3 is written in step SM36, and generated. In steps SM37, SM38, the time data of key-ON time of the G3 is latched in the latch 11, the address 35 is designated, and the process is advanced to the RAM 5 in FIG. 12A.

Figure 19A:
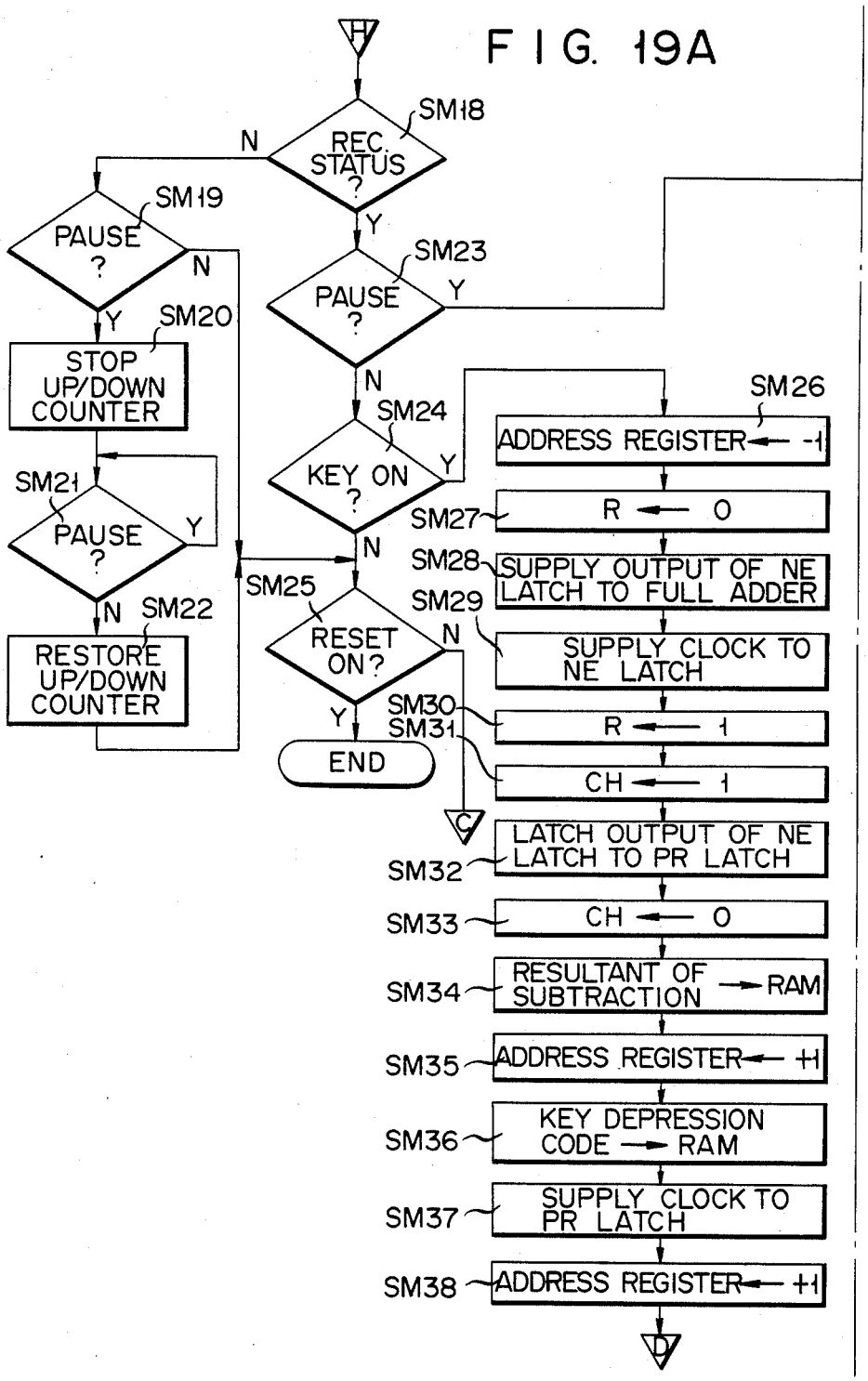
FIGS. 19A and 19B are flow charts of another different reproducing process of melody information.
Figure 19B:
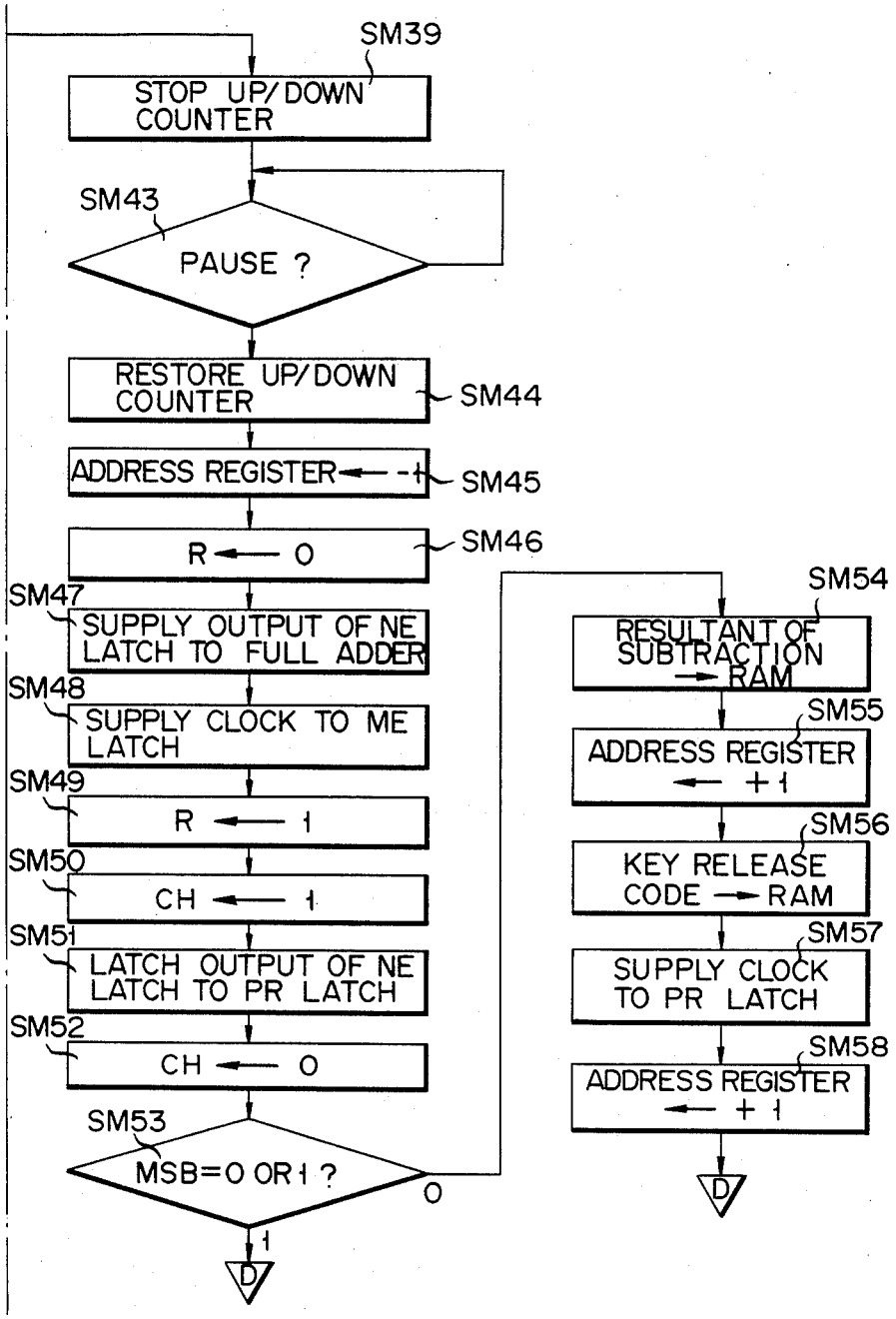

FIGS. 19A and 19B show another example of a correcting process. In FIGS. 19A and 19B, the steps SM40, SM41 and SM42 in FIGS. 14B-I and 14B-II are omitted. Accordingly, the recording state is set by turning the pause key 1E ON, turning any of the keys ON and then turning the pause key 1E OFF in FIGS. 15 and 17. The recording state can, however, be set by turning the pause key 1E OFF without turning ON any key.

According to the present invention as described above, an automatic music playing apparatus which can temporarily stop reproducing operation at a predetermined position, i.e., in the vicinity of correction by reproducing when recorded tone information is corrected, and then automatically setting the recording state upon releasing of the temporary stop, is provided. Therefore, the key-ON timing for correction can be readily taken, thereby advantageously facilitating the editing work.

Further, according to the present invention, an automatic music playing apparatus which can back the address of the memory means from the state in which the tone information of a music is set, then starting reproducing performance from an arbitrary position, temporarily stopping the performance during the reproducing performance, and immediately setting the tone information memory enable state in the memory means when the pause instruction is released, is provided. Therefore, the editing work of a music piece can advantageously be readily carried out.

What is claimed is:

1. An automatic music playing apparatus, comprising:

player operable manual tone information input means for simultaneously inputting a plurality of tone information, each tone information including one pitch information and one ON/OFF information, to be generated simultaneously together with one another;

counter means for outputting timing information when the contents of said tone information change;

memory means for storing said tone information designated by said tone information input means and timing information outputted from said counter means when the contents of said tone information change; and tone signal generation means coupled to said memory means for simultaneously generating a plurality of tone signals including plural pitches according to the plurality of tone information and the timing information read out from said memory means, and means for sounding said plurality of tone signals simultaneously in accordance with the read out timing information.

2. The automatic music playing apparatus according to claim 1, wherein said memory means continuously stores a plurality of to be tone information to be in one memory area.

3. The automatic music playing apparatus according to claim 1, wherein said tone signal generation means generates a tone signal based on tone information to be simultaneously generated by discriminating said timing information contained in the tone information.

4. The automatic music playing apparatus according to claim 1, wherein said memory means comprises a plurality of areas, each of which can individually store tone information, and said automatic music playing apparatus further comprises control means, for restoring the tone information stored in said plurality of areas in one area by adjusting the timing information contained in the tone information.

5. The automatic music playing apparatus according to claim 1, wherein said memory means include a first memory means for storing said plurality of tone information input from said tone information input means, said apparatus further including processing means coupled to said first memory means, for reproducing the tone information stored in said first memory means, to generate a corresponding tone, and wherein said memory means further include a second memory means for storing different tone information when such different tone information is input by said tone information input means during reproducing of the tone information stored in said first memory means by said process means.

6. The automatic music playing apparatus according to claim 5, wherein said tone information input means comprises a keyboard having a plurality of keys.

7. The automatic music playing apparatus according to claim 5, wherein said first and said second memory means are different areas of a common memory device.

8. The automatic music playing apparatus according to claim 5, wherein said first and said second memory means can individually store tone information, and said automatic music playing apparatus further comprises control means, for restoring individual tone information stored in said first and said second memory means in third memory means by adjusting timing information contained in the tone information.

9. The automatic music playing apparatus according to claim 5, wherein said first memory means is arranged to store tone information of a first melody, and said second memory means is arranged to store tone information of a second melody different from said first melody.

10. The automatic music playing apparatus according to claim 1, wherein said tone information input means include tone information setting means for setting tone information of a music piece in said memory means;

said tone signal generation means include means coupled to said memory means, for reading out the tone information set in said memory means to reproduce and perform the music piece; and said apparatus further comprises:

instruction means for selectively instructing and cancelling a pause of the reproducing performance of the music piece during the reproducing performance when the tone information is read out from said memory means by said reading means; and means for realizing a reproducing performance when an instructed pause is cancelled, and for storing into said memory means tone information newly input by operation of said tone information setting means for substitution of tone information stored in said memory means.

11. The automatic music playing apparatus according to claim 10, wherein said instruction means is operative to set new tone information in said memory means when said instruction means cancels a pause made during the reproducing performance of the music piece and a corresponding keying operation of said tone information setting means is made before cancellation of said pause.

12. The automatic music playing apparatus according to claim 11, further comprising:

counter means for outputting timing information when the contents of said tone information change;

and wherein said tone information setting means comprises means for simultaneously setting a plurality of tone information including pitch information, ON/OFF information to be generated simultaneously together with the pitch information, and said timing information outputted from said counter means when the contents of said tone information change; and said reading out means coupled to said memory means comprises tone signal generation means for simultaneously generating tone signals according to the plurality of tone information read out from said memory means, and for sounding a plurality of tones simultaneously in accordance with the read out timing information.

13. The automatic music playing apparatus according to claim 10, further comprising:

counter means for outputting timing information when the contents of said tone information change;

and wherein said tone information setting means comprises means for simultaneously setting a plurality of tone information including pitch information, ON/OFF information to be generated simultaneously together with the pitch information, and said timing information outputted from said counter means when the contents of said tone information change; and said reading out means coupled to said memory means comprises tone signal generation means for simultaneously generating tone signals according to the plurality of tone information read out from said memory means, and for sounding a plurality of tones simultaneously in accordance with the read out timing information.

14. The automatic music playing apparatus according to claim 1, which further comprises:

control means including sequence designation means for designating one of normal sequence and reverse sequence of tone reproduction, and address designation means for designating an address of said memory means in normal sequence or reverse sequence according to the designation of said sequence designation means, for reading out tone information stored in said memory means to reproduce and perform a music piece;

instruction means for selectively instructing and cancelling a pause of the reproducing performance by reading out the tone information from said memory means by said control means; and means for setting said memory means to a tone information set enable state immediately when said instruction means cancels said pause.

15. The automatic music playing apparatus according to claim 14, further comprising:

counter means for outputting timing information when the contents of said tone information change;

and wherein said tone information setting means comprises means for simultaneously setting a plurality of tone information including pitch information, ON/OFF information to be generated simultaneously together with the pitch information, and said timing information outputted from said counter means when the contents of said tone information change; and said control means comprises tone signal generation means for simultaneously generating tone signals according to the plurality of tone information read out from said memory means, and for sounding a plurality of tones simultaneously in accordance with the read out timing information.

16. The automatic music playing apparatus according to claim 1, wherein said tone information input means include tone information setting means for setting tone information of music in said memory means; and said apparatus further comprises:

means for reading out the tone information set in said memory means to reproduce and perform the music;

instruction means for selectively instructing and cancelling a pause of a reproducing performance of music during the reproducing performance made by the reading out of the tone information from said memory means; and means for setting new tone information in said memory means when said instruction means cancels a pause made by said instruction means during a reproducing performance of the music.

17. The automatic music playing apparatus according to claim 16, further comprising:

counter means for outputting timing information when the contents of said tone information change;

wherein said tone information setting means comprises means for simultaneously setting a plurality of tone information including pitch information, ON/OFF information to be generated simultaneously together with the pitch information, and said timing information outputted from said counter means when the contents of said tone information change; and said tone information reading out means comprises tone signal generation means for simultaneously generating tone signals according to the plurality of tone information read out from said memory means, and for sounding a plurality of tones simultaneously in accordance with the read out timing information.

18. The automatic music playing apparatus according to claim 1, wherein the timing information outputted by said counter means shows a time difference corresponding to that between a time when the contents of said tone information change and the next time when said contents change.

19. An automatic music playing apparatus, comprising:

playing operable manual tone information input means for simultaneously inputting a plurality of tone information, each tone information including one pitch information and one ON/OFF information, to be generated simultaneously together with one another;

counter means for outputting timing information when the contents of said tone information change;

first memory means for storing said tone information designated by said tone information input means and timing information outputted from said counter means when the contents of said tone information change;

first tone signal generation means coupled to said first memory means for simultaneously generating a plurality of tone signals including plural pitches according to the plurality of tone information and the timing information read out from said first memory means, and means for sounding said plurality of tone signals simultaneously in accordance with the timing the timing information read out from said first memory means;

second memory means for storing different tone information designated by said tone information input means and timing information outputted from said counter means when the contents of said tone information change during reproducing said tone signals by said tone signal generation means; and second tone signal generation means coupled to said second memory means for simultaneously generating tone signals according to the plurality of tone information and the timing information read out from said second memory means, and for sounding a plurality of tones simultaneously in accordance with the timing information read out from said second memory means.

20. The automatic music playing apparatus according to claim 19, wherein said tone information input means comprises a keyboard including a plurality of keys.

21. The automatic music playing apparatus according to claim 19, wherein said first and said second memory means are different areas of a common memory device.

22. The automatic music playing apparatus according to claim 19, wherein said first and said second memory means operate individually to store tone information, and said automatic music playing apparatus further comprises third memory means, and control means for restoring individual tone information stored in said first and said second memory means in said third memory means including means for adjusting timing information contained in the tone information.

* * * * *